US011383527B2

(12) United States Patent
Arakane

(10) Patent No.: US 11,383,527 B2
(45) Date of Patent: Jul. 12, 2022

(54) LIQUID DROPLET DISCHARGE APPARATUS

(71) Applicant: BROTHER KOGYO KABUSHIKI KAISHA, Nagoya (JP)

(72) Inventor: Satoru Arakane, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/160,822

(22) Filed: Jan. 28, 2021

(65) Prior Publication Data

US 2021/0237472 A1 Aug. 5, 2021

(30) Foreign Application Priority Data

Jan. 30, 2020 (JP) ..... JP2020-013299

(51) Int. Cl.
*B41J 2/21* (2006.01)
*B41J 2/155* (2006.01)

(52) U.S. Cl.
CPC ..... *B41J 2/2135* (2013.01); *B41J 2/155* (2013.01); *B41J 2/2146* (2013.01); *B41J 2202/21* (2013.01)

(58) Field of Classification Search
CPC . B41J 2/2132; B41J 29/38; B41J 2/155; B41J 29/393; B41J 2/2135; B41J 2/04573; B41J 2/2146; B41J 3/543; B41J 3/54; B41J 2202/21
See application file for complete search history.

(56) References Cited

U.S. PATENT DOCUMENTS 7,377,610 B2 * 5/2008 Hirakawa ..... B41J 2/2132 347/15
10,479,074 B2 * 11/2019 Arakane ..... B41J 2/2135

FOREIGN PATENT DOCUMENTS

JP 2007-296748 A 11/2007

* cited by examiner

*Primary Examiner* — Jannelle M Lebron
(74) *Attorney, Agent, or Firm* — Scully, Scott, Murphy & Presser, PC

(57) ABSTRACT

A head unit includes: X (X≥2) of first type nozzles configured to discharge a first type liquid droplet, and W (1≤W<X) of a second type nozzle configured to discharge a second type liquid droplet. The head unit generates first data forming a first dot pattern and indicating a preceding first type dot area as an area in which the first type liquid droplet is to be discharged, and a preceding second type dot area as an area in which the second type liquid droplet is to be discharged; and second data for forming a second dot pattern and indicating a succeeding first type dot area as an area in which the first type liquid droplet is to be discharged, and a succeeding second type dot area as an area in which the second type liquid droplet is to be discharged.

9 Claims, 19 Drawing Sheets

LIQUID DROPLET DISCHARGE APPARATUS

CROSS REFERENCE TO RELATED APPLICATION

The present application claims priority from Japanese Patent Application No. 2020-013299, filed on Jan. 30, 2020, the disclosure of which is incorporated herein by reference in its entirety.

BACKGROUND

Field of the Invention

The present specification relates to a technique of executing, a plurality of times, each of a forming processing of discharging droplets of a liquid onto a medium from a plurality of nozzles provided on a head unit while causing the head unit to move in a main scanning direction relative to the medium, and a conveying processing of conveying the medium in a sub scanning direction to thereby form a dot pattern.

Description of the Related Art

Conventionally, there is known a printer which prints an image by discharging an ink from a plurality of nozzles of a head unit having the plurality of nozzles. For example, the following printer is publicly known. In the publicly-known printer, a nozzle row for a yellow ink provided with 90 pieces of nozzle and a nozzle row of a cyan ink provided with 180 pieces of nozzle are formed in a lower surface of the head. By discharging an ink while the head is being moved, a dot row (raster line) along the moving direction of the head is formed on a paper. Here, during one time of the movement of the head, the nozzle row for the cyan ink forms dots in pictures pixels of an odd-numbered dot row or an even-numbered dot row, and the nozzle row for the yellow ink forms dots in pixels of both of the odd-numbered dot row and the even-numbered dot row. The dot row of the cyan ink is completed by two times of the moving, and the dot row of the yellow ink is completed by one time of the moving. In such a manner, the raster line of the cyan ink is formed in accordance with an overlap printing, and the raster line of the yellow ink is formed in accordance with a band printing.

In a case that the numbers of the nozzles (nozzle numbers) are different depending on the kinds of the inks, the speed of the printing is restricted by the nozzle number which is smaller among the nozzle numbers. Such a task is common not only in the technique of printing an image by using the inks, but also in the technique of forming dots by discharging the liquid droplets.

The present specification discloses a technique capable of improving a speed of forming a dot pattern.

The technique disclosed in the present specification can be realized as the following example of application.

A liquid droplet discharge apparatus including: a head unit having X of first type nozzles ($X \geq 2$) configured to discharge a first type liquid droplet of a first liquid and W of a second type nozzle ($1 \leq W < X$) configured to discharge a second type liquid droplet of a second liquid, wherein positions of the X of the first type nozzles in a sub scanning direction are different from each other, and positions of the W of the second type nozzles in the sub scanning direction are different from each other; a moving device configured to move the head unit relative to a medium in a main scanning direction orthogonal to the sub scanning direction; conveyor configured to convey the medium relative to the head unit in the sub scanning direction; and a controller configured to control the head unit, the moving device, and the conveyor. The controller is configured to: execute, a plurality of times, each of a forming processing and a conveying processing, wherein the forming processing is a processing in which dots are formed on the medium by the head unit while causing the moving device to move the head unit relative to the medium in the main scanning direction, and the conveying processing is a processing in which the medium is conveyed in the sub scanning direction by the conveyor; generate first data for forming a first dot pattern by executing the forming processing T time ($T \geq 1$), the first data indicating a preceding first type dot area as an area in which the first type liquid droplet is to be discharged, and a preceding second type dot area as an area in which the second type liquid droplet is to be discharged; and generate second data for forming a second dot pattern by executing the forming processing U time ($U \geq 1$), following formation of the first dot pattern, the second data indicating a succeeding first type dot area as an area in which the first type liquid droplet is to be discharged, and a succeeding second type dot area as an area in which the second type liquid droplet is to be discharged. A first type overlap dot range is defined as a part, in which a preceding first type dot range as a range in the sub scanning direction of the preceding first type dot area overlaps with a succeeding first type dot range as a range in the sub scanning direction of the succeeding first type dot area. In a second type overlap dot range is defined as a part, in which a preceding second type dot range as a range in the sub scanning direction of the preceding second type dot area overlaps with a succeeding second type dot range as a range in the sub scanning direction of the succeeding second type dot area. The controller is configured to: determine as to whether or not a first condition for forming the first type overlap dot range and the second type overlap dot range is satisfied, and determine as to whether or not a second condition for forming the first type overlap dot range, without forming the second type overlap dot range, is satisfied. The controller is configured to generate the first data and the generation of the second data such that the number of times of executing the forming processing of discharging the liquid droplets to an area of the first type overlap dot range in a case that the controller has determined that the second condition is satisfied is made to be smaller than the number of times of executing the forming processing of discharging the liquid droplets to the area of the first type overlap dot range or to an area of the second type overlap dot range in a case that the controller has determined that the first condition is satisfied.

According to this configuration, in a case that the controller determines that the first condition is satisfied, the preceding first type dot range and the succeeding first type dot range include the first type overlap dot area, and the preceding second type dot range and the succeeding second type dot range include the second type overlap dot area; thus, it is possible to suppress such a situation that the boundary between the preceding first type dot range and the succeeding first type dot range becomes to be conspicuous, and to suppress such a situation that the boundary between the preceding second type dot range and the succeeding second type dot range becomes to be conspicuous. Further, the controller is configured to generate the first data and the second data so that the number of times of executing the forming processing of discharging the liquid droplets to the area of the first type overlap dot range in a case that the controller determines that the second condition for forming the first type overlap dot range, without forming the second type overlap dot range is satisfied is made to be smaller than the number of times of executing the forming processing of discharging the liquid droplets to the area of the first type overlap dot range or to the area of the second type overlap dot range in a case that the controller determines that the first condition for forming the first type overlap dot range and the second type overlap dot range is satisfied. Thus, the speed of the dot pattern formation can be improved in the former case, than in the latter case.

Note that the technique disclosed in the present specification can be realized in a various kinds of aspects. For example, the technique can be realized in aspects including: a method of controlling a mechanism which is configured to execute discharge of liquid droplets and a controller configured to control the mechanism; a method of generating control data for controlling the mechanism which is configured to execute the discharge of the liquid droplets, and a generating device configure to generate the control data; and a non-volatile medium storing a computer program configured to realize the functions of the methods or devices; etc.

DESCRIPTION OF THE EMBODIMENTS

First Embodiment

<Configuration of Apparatus>

Figure 1:
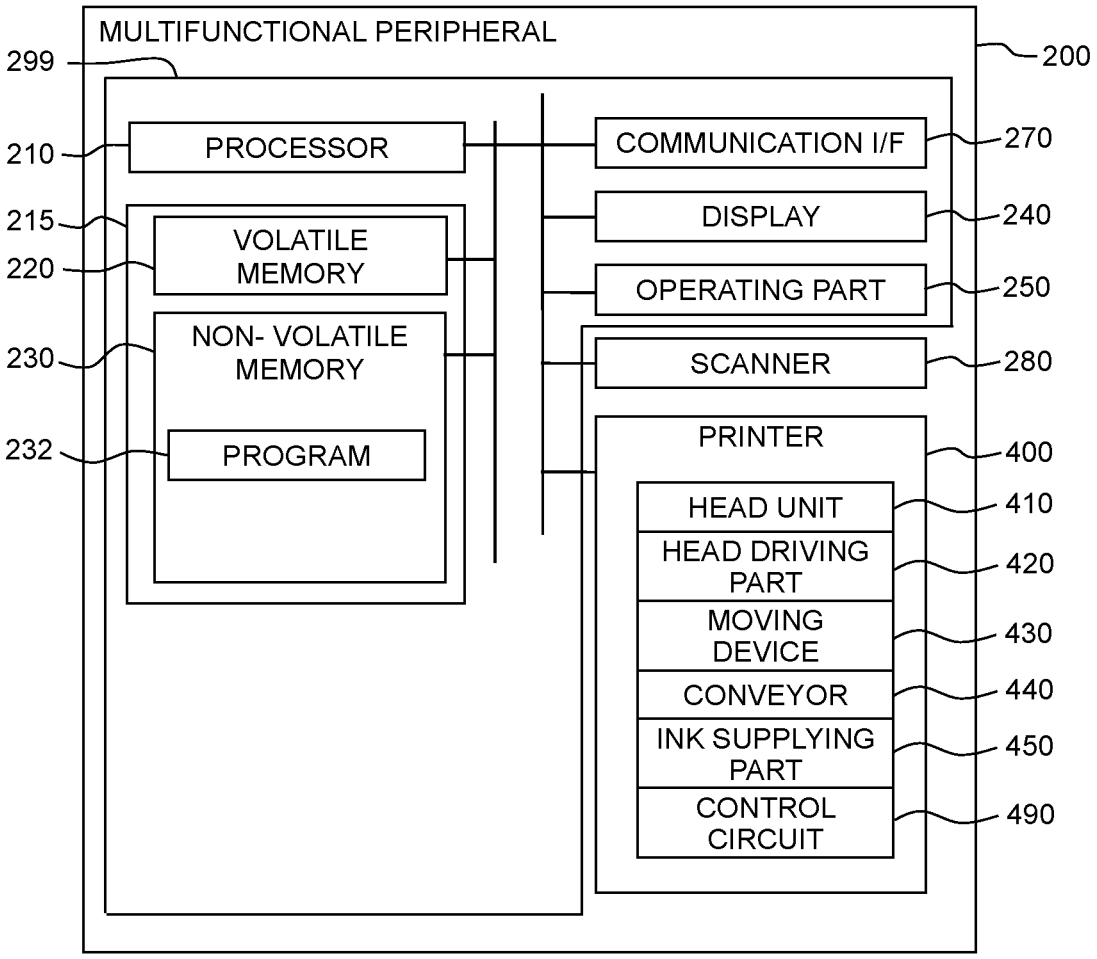
FIG. 1 is a view explaining a multifunctional peripheral 200.

FIG. 1 is a view explaining a multifunctional peripheral 200 as an embodiment of a liquid droplet discharge apparatus. The multifunctional peripheral 200 has a controller 299, a scanner 280 and a printer 400. The controller 299 has a processor 210, a memory 215, a display 240 configured to display an image, an operating part 250 configured to receive an instruction by a user and a communication interface 270. These elements are connected to one another via a bus. The memory 215 includes a volatile memory 220 and a non-volatile memory 230.

The processor 210 is a device performing a data processing, and is, for example, a CPU. The volatile memory 220 is, for example, a DRAM, and the non-volatile memory 230 is, for example, a flash memory.

The non-volatile memory 230 stores a program 232. The processor 210 executes the program 232 to thereby realize a variety of kinds of functions (to be described in detail later on). The processor 210 temporarily stores a variety of kinds of intermediate data to be used for executing the program 232 in the memory (for example, either one of the volatile memory 220 and the non-volatile memory 230). In the present embodiment, the program 232 is stored in advance in the non-volatile memory 230, as a firmware, by the manufacturer of the multifunctional peripheral 200.

The display 240 is a device which displays an image, such as a liquid crystal display, an organic EL display, etc. The operating part 250 is a device such as a touch panel, a button, a lever, etc., which is arranged on the display part 240 to be overlapped therewith and which receives an operation by the user. The user operates the operating part 250 so that the user can input a variety of kinds of instructions to the multifunctional peripheral 200. The communication interface 270 is an interface for communicating with another device or apparatus (for example, USB interface, a wired LAN interface, a wireless interface of IEEE 802.11).

The scanner 280 is a reading device which optically reads an object such as an original, manuscript, etc., by using a photoelectric conversion element such as a CCD, CMOS, etc. The scanner 280 generates read data (for example, RGB bitmap data) indicating an image which is read (also referred to as a "read image").

The printer 400 is a device configured to print an image on a paper sheet (paper; an example of a medium). In the present embodiment, the printer 400 has a head unit 410 (also simply referred to as a "head 410"), a head driving part 420, a moving device 430, a conveyor 440, an ink supplying part 450, and a control circuit 490 configured to control the above-described elements 410, 420, 430, 440 and 450. The printer 400 is a printer of an ink-jet system using respective inks which are a cyan ink C, a magenta ink M, a yellow ink Y and a black ink K. The control circuit 490 is constructed, for example, of a dedicated electric circuit which drives a motor, etc. The control circuit 490 may include a computer.

The controller 299 uses image data selected by the user to thereby generate print data, and is capable of using the generated print data so as to cause the printer 400 to print an image. The user can select the read image and/or image data stored in an external memory (for example, a memory card connected to the communication interface 270). Further, the controller 299 is capable of using print data supplied by another external apparatus connected to the multifunctional peripheral 200 so as to cause the printer 400 to perform printing of the image.

Figure 2:
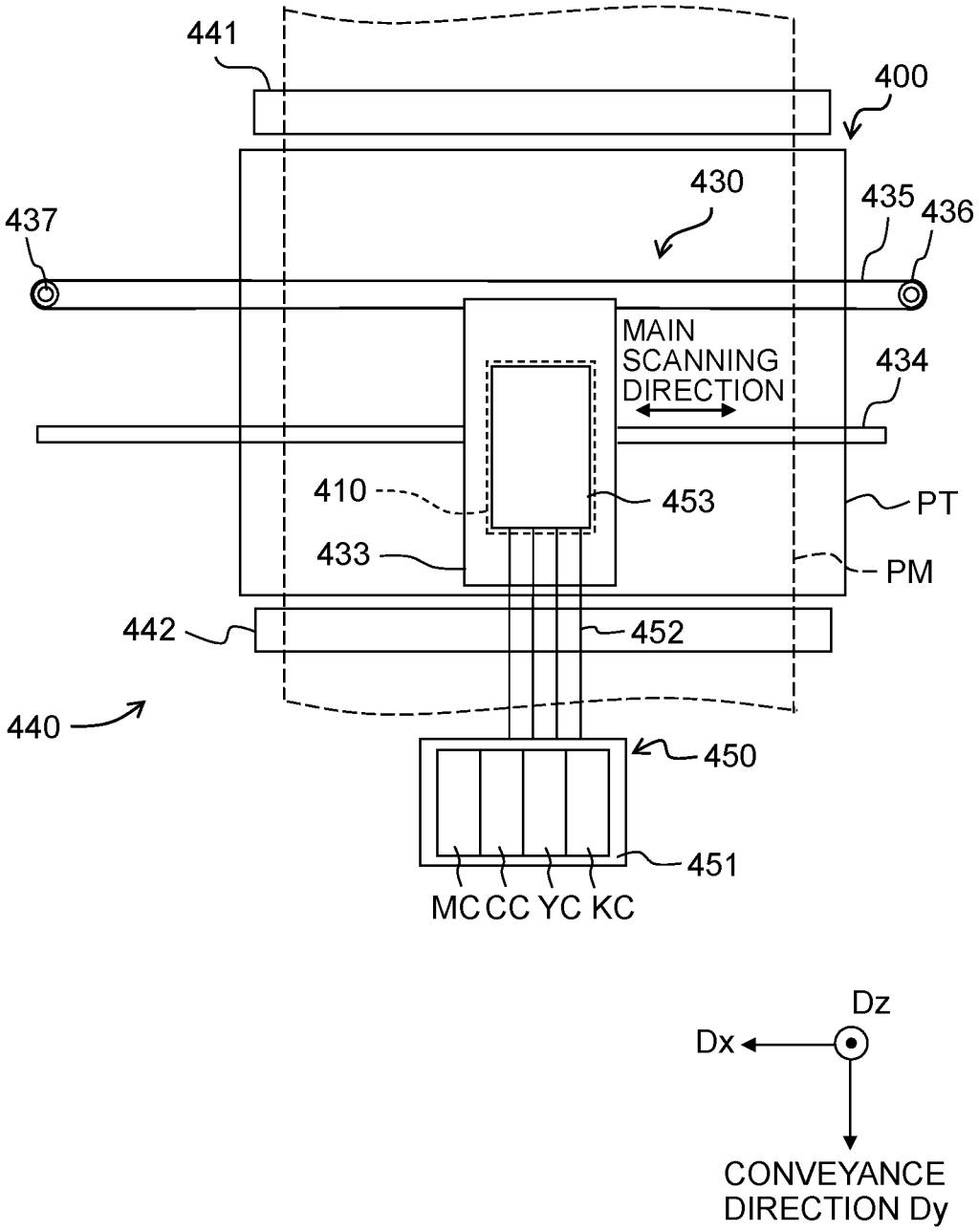
FIG. 2 is a schematic view of a printer 400.

FIG. 2 is a schematic view of the printer 400. The moving device 430 is provided with a carriage 433, a sliding shaft 434, a belt 435 and a plurality of pulleys 436 and 437. The carriage 433 mounts the head 410 thereon. The sliding shaft 434 holds the carriage 433 to be reciprocally movable along a main scanning direction (a direction parallel to a direction Dx). The belt 435 is wound and stretched between the pulleys 436 and 437, and a part of the belt 435 is fixed to the carriage 433. The pulley 436 is rotated by the motive force of a non-illustrated main scanning motor. In a case that the main scanning motors rotates the pulley 436, the carriage 433 moves along the sliding shaft 434. With this, a main scanning of moving the head 410 reciprocally, relative to a paper sheet PM, along the main scanning direction is realized.

The conveyor 440 conveys the paper sheet PM, relative to the head 410, in a direction Dy which is orthogonal to the main scanning direction, while holding the paper sheet PM. In the following, the direction Dy is also referred to as a "conveying direction Dy". Further, the direction Dy is also referred to as a "direction +Dy", and a direction opposite to the direction +Dy is also referred to as a "direction −Dy". This is applicable similarly to a direction +Dx and a direction −Dx. The printing of an image on the paper sheet PM is progressed from a side of the +Dy direction on the paper sheet PM toward a side of the −Dy direction. In the following, the direction +Dy is also referred to as an upstream direction, and the direction −Dy is also referred to as a downstream direction.

The conveyor 440 is provided with: a platen PT arranged at a position facing a surface, of the head 410, from which an ink is discharged or ejected, and configured to support the paper sheet PM; a first roller 441 and a second roller 442 each of which is configured to hold the paper sheet PM arranged on the platen PT; and a non-illustrated motor configured to drive the first roller 441 and the second roller 442. The first roller 441 is arranged on a side of the direction −Dy relative to the head 410, and the second roller 442 is arranged on a side of the direction +Dy relative to the head 410. The paper sheet PM is supplied from a non-illustrated paper sheet tray to the conveyor 440 by a non-illustrated paper sheet feeding roller. The paper sheet PM supplied to the conveyor 440 is pinched or held between the first roller 441 and a non-illustrated following roller which pairs with the first roller 441, and is conveyed to the side of the conveying direction Dy (also referred to as a "sub scanning direction Dy") by these rollers. The conveyed paper sheet PM is pinched or held between the second roller 442 and a non-illustrated following roller which pairs with the second roller 442, and is conveyed to the side of the sub scanning direction Dy by these rollers. The conveyor 440 drives the first and second rollers 441 and 442 by the motive power of the motor to thereby convey the paper sheet PM in the conveying direction Dy. In the following, a processing of moving the paper sheet PM in the conveying direction Dy is also referred to as a "sub scanning", or a "conveying processing". As described above, the conveying direction Dy is also referred to as the "sub scanning direction Dy". A direction Dz in the drawings is a direction from the platen PT toward the head 410, perpendicularly with respect to the two directions Dx and Dy.

The ink supplying part 450 supplies an ink to the head 410. The ink supplying part 450 is provided with a cartridge install part 451, a tube 452 and a buffer tank 453. A plurality of ink cartridges KC, YC, CC and MC each of which is a container having an ink stored or accommodated therein are detachably installed in the cartridge install part 451, and the ink is supplied from each of the ink cartridges KC, YC, CC and MC. The buffer tank 453 is arranged in the carriage 433 at a location above the head 410, and temporarily stores the inks, regarding each of the inks C, M, Y and K to be supplied to the head 410. The tube 452 is a tube having a flexibility and which serves as a channel of the ink connecting the cartridge install part 451 and the buffer tank 453. The ink inside each of the ink cartridges is supplied to the head 410 via the cartridge install part 451, the tube 452 and the buffer tank 453.

Figure 3:
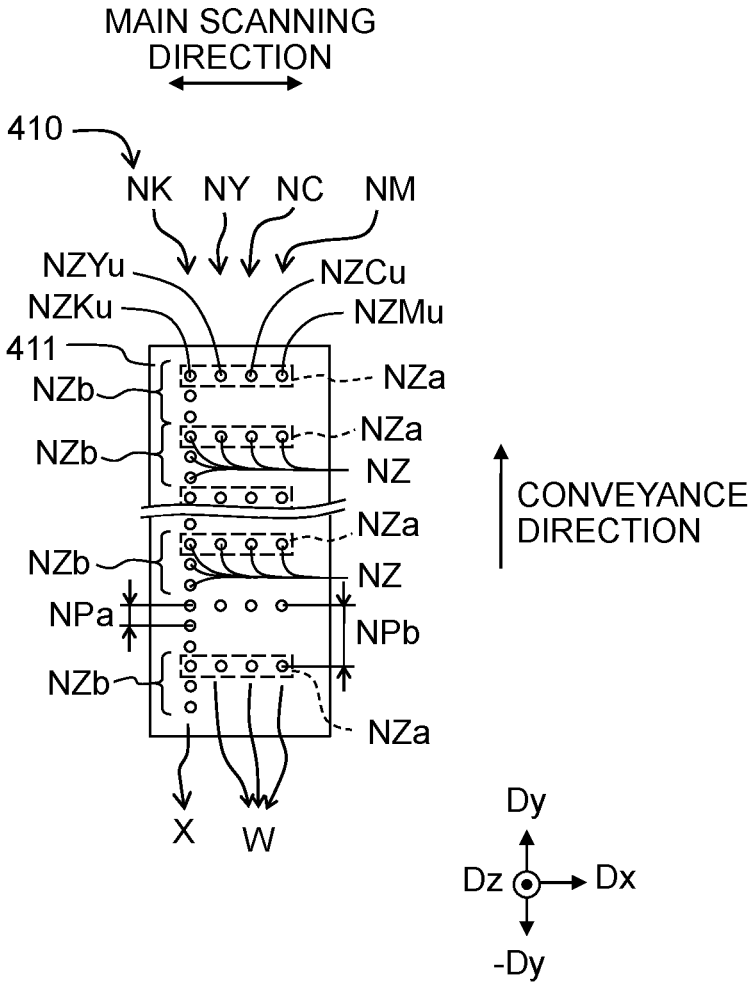
FIG. 3 is a perspective view depicting the configuration of a head 410.

FIG. 3 is a perspective view of the head 410 as seen while being oriented in the direction −Dz. In the drawing, unlike in FIG. 2, the sub scanning direction Dy is oriented upward. A nozzle formation surface 411 which is a surface, of the head 410, on a side of the direction −Dz is formed with nozzle groups NK, NY, NC and NM which discharge or eject the respective inks K, Y, C and M as described above. Each of the nozzle groups NK, NY, NC and NM includes a plurality of nozzles NZ. In the plurality of nozzles NZ in one of the nozzle groups, the positions thereof in the sub scanning direction Dy are mutually different. The positions in the main scanning direction of the nozzle groups NK, NY, NC and NM are mutually different. In an example depicted in FIG. 3, the nozzle groups NK, NY, NC and NM are arranged side by side in this order toward the direction +Dx.

In the nozzle group NK of black K in the present embodiment, the positions in the sub scanning direction Dy of the plurality of nozzles NZ are arranged at equal intervals therebetween with a first nozzle pitch NPa. In each of the nozzle groups NY, NC and NM of yellow, cyan and magenta (YCM), the positions in the sub scanning direction Dy of the plurality of nozzles NZ are arranged at equal intervals therebetween with a second nozzle pitch NPb. Each of the pitches NPa and NPb is a difference in the positions in the sub scanning direction Dy of two nozzles NZ, among the plurality of nozzles NZ, which are adjacent in the sub scanning direction Dy. In the present embodiment, the second nozzle pitch NPb is F times (F is an integer of not less than 2) the first nozzle pitch NPa. In the example depicted in FIG. 3, F is 3 (F=3).

The drawing depicts upstream-most nozzles NZKu, NKYu, NZCu, NZMu which are positioned on the upstream-most side (the side of the direction +Dy) in the nozzle groups NK, NY, NC and NM, respectively. In the present embodiment, the positions in the sub scanning direction Dy are same among the upstream-most nozzles NZKu, NKYu, NZCu, NZMu. In the drawing, a plurality of nozzle sets NZa are indicated. Each of the plurality of nozzle sets NZa is constructed of four pieces of nozzles NZ each one of which is selected from one of the four nozzle groups NK, NY, NC and NM, and is a set of the four nozzles arranged at a same position in the sub scanning direction Dy (hereinafter, the nozzle set NZa is also referred to as a "same position set NZa"). As described above, the second nozzle pitch NPb is the F times the first nozzle pitch NPa. Accordingly, in a case of following the plurality of nozzles NZ in the black nozzle group NZ in the direction −Dy, one set of the same position set NZa is formed every F pieces of the nozzle NZ.

Further, in the present embodiment, the total number of the nozzles NZ is a same W (W piece) among the respective nozzle groups NY, NY and NM of the YCM (yellow, cyan and magenta). Furthermore, the total number of the nozzle NZ in the black nozzle group NK is X (X pieces). Moreover, in the present embodiment, X is F times of W. Accordingly, the nozzle groups NK, NY, NC and NM form W piece(s) of the nozzle set NZb which are aligned side by side in the sub scanning direction Dy. Each of the nozzle sets NZb is constructed of one piece of the same position set NZa and "F-1" pieces of the nozzle NZ of the black K following the same position set NZa on the side of the direction −Dy (hereinafter, the nozzle set NZb is also referred to as a "standard set NZb"). In the example depicted in FIG. 3, one set of the nozzle set NZb is constructed of one set of the same position set NAz and additional two nozzles NZ of the black K. Note that X is an integer of not less than 2; and that W is an integer in a range of not less than 1 and less than X. The position(s) in the sub scanning direction Dy of W piece of the nozzle NZ of the black K among X pieces of the nozzle NZ of the black K (here, W piece of the nozzle NZ of the same position set NZa) is (are) same as the position(s) in the sub scanning direction Dy of W piece of the nozzle NZ of the color (for example, cyan C).

The respective nozzles NZ are connected to the buffer tank 453 (FIG. 2) via ink channels (of which illustration is omitted in the drawings), respectively, which are formed in the inside of the head 410. The ink channels are provided with actuators, respectively (of which illustration is omitted in the drawings; for example, a piezoelectric element, heater, etc.,) configured to discharge or eject the ink.

The head driving part 420 (FIG. 1) includes an electric circuit which drives each of the actuators in the inside of the head 410 during the main scanning by the moving device 430. With this, the ink is discharged or ejected from the nozzles NZ of the head 410 onto the paper sheet PM to thereby form dots. In the following, a processing of discharging or ejecting the ink droplets from the nozzles NZ of the head 410 onto the paper sheet PM while moving the head unit 410 in the main scanning direction is also referred to as a forming processing. The head 410, the head driving part 420 and the moving device 430 perform the forming processing to thereby form the image on the paper sheet PM.

<Outline of Printing>

Figure 4:
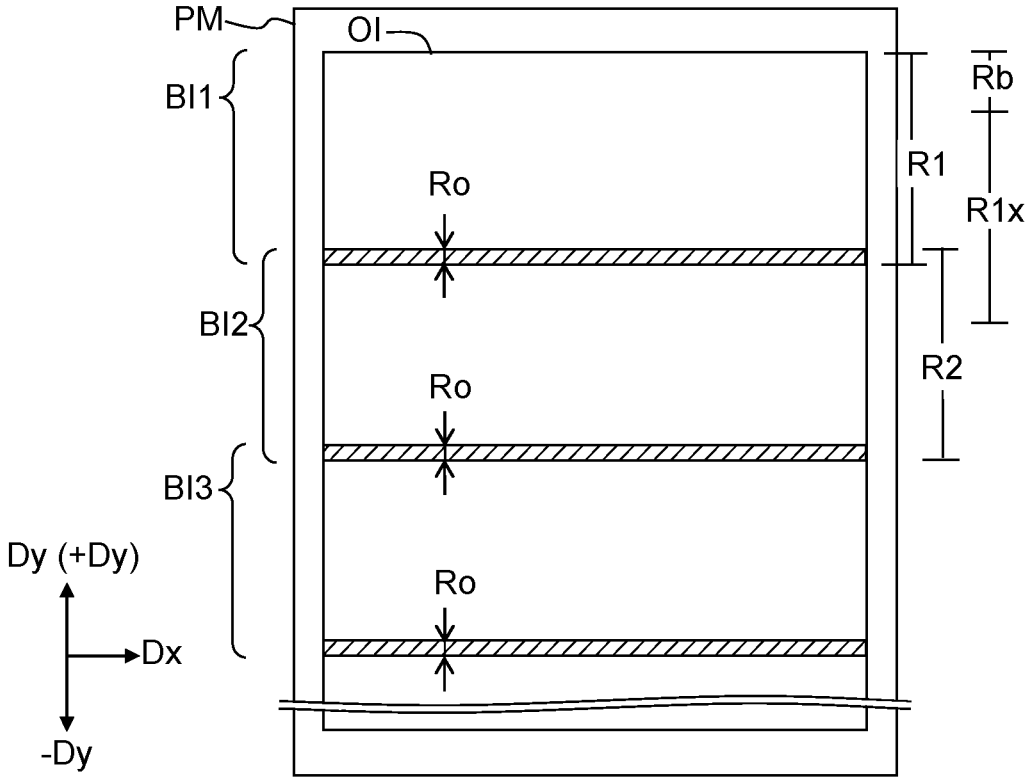
FIG. 4 is a view for explaining the outline of printing.

FIG. 4 is a view for explaining the outline of printing by the printer 400. In FIG. 4, an object image OI to be printed on the paper sheet PM is depicted. The object image OI includes a plurality of band images BI1 to BI3 which are arranged side by side from an end on the side of the direction +Dy in the direction −Dy (more generally, the sub scanning direction Dy) of the object image OI. The shape of each of the band images BI1 to BI3 is a rectangular extending in the main scanning direction (here, a direction parallel to the direction Dx). The width in the sub scanning direction Dy of each of the band images BI1 to BI3 may be changed depending on the object image OI. Each of the band images BI1 to BI3 is formed by one time or a plurality of times of the forming processing (by the forming processing executed one time or a plurality of times). In the following, one time of the forming processing is also referred to as a "pass processing" or simply as a "pass". In each of the forming processings, the head 410 is moved in either one direction of a bidirectional scanning direction (the direction +Dx and the direction −Dx). Here, a forming processing in the direction +Dx and a forming processing in the direction −Dx may be performed alternately (also referred to as a bidirectional printing). Instead of this, it is allowable that a moving direction of the head 410 in the forming processing may be one direction which is determined previously or in advance.

The plurality of band images are printed one by one, from a band image at an end in the direction +Dy of the object image OI toward the direction −Dy. In such a manner, each of the forming processing and the conveying processing is executed a plurality of times. In the example depicted in FIG. 4, ranges in the sub scanning direction Dy of two band images, among the plurality of band images, which are adjacent to each other partially overlap with each other. An overlap range Ro in FIG. 4 indicates a range in which the ranges in the sub scanning direction Dy of the two band images which are adjacent to each other overlap with each other. For example, an overlap range Ro closest to the side of the direction +Dy is a range at which a range in the sub scanning direction Dy of a first band image BI1 and a range in the sub scanning direction Dy of a second band image BI2 overlap with each other. The shape of an image included in such an overlap ranger Ro is a rectangular extending in the main scanning direction. In the present embodiment, the width in the sub scanning direction Dy of each of the overlap ranges Ro is a fixed value which is determined in advance. Note that a plurality of dots included in the overlap are Ro are printed while being distributed to two band images. Namely, during printing of the band image on the upstream side (on the side of the direction +Dy), dots as a part of the plurality of dots inside the overlap range Ro are printed. Further, during printing of the band image on the downstream side (on the side of the direction −Dy), dots as a remaining part of the plurality of dots inside the overlap range Ro are printed. With this, in a boundary (namely, the overlap range Ro) between the image on the upstream side (side of the direction +Dy) and the band image on the downstream side (side of the direction of −Dy), any deficiency or fault in a printed color (for example, any white streak, unevenness in density, etc.) can be suppressed. Note, as will be described later on, that in the present embodiment, whether or not the ranges in the sub scanning direction Dy of two band images which are adjacent to each other overlap with each other are determined based on the image.

Figure 5:
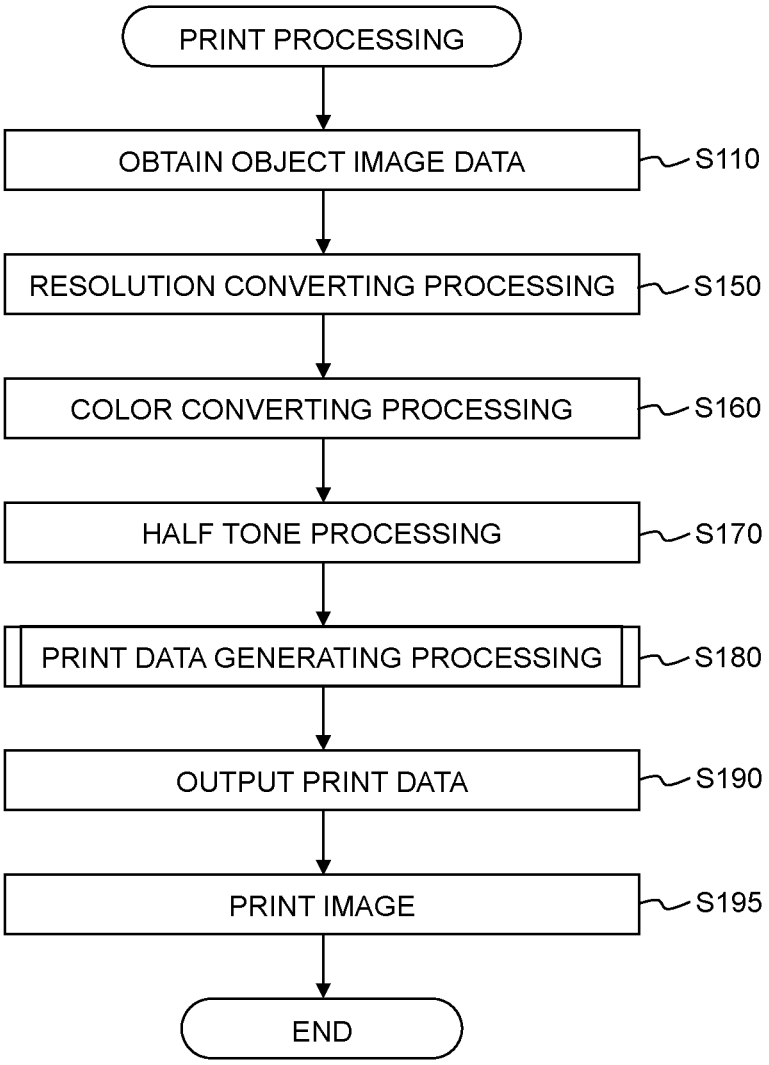
FIG. 5 depicts a flowchart indicating an example of a print processing.

FIG. 5 is a flowchart indicating an example of the print processing. In the following, it is presumed that the controller 299 of the multifunctional peripheral 200 starts the processing of FIG. 5, in accordance with a printing instruction from the user. The processor 210 executes the processing of FIG. 5 in accordance with the program 232. A method of inputting the printing instruction may be an arbitrary method. In the present embodiment, the user operates the operating part 250 (FIG. 1) to thereby input the printing instruction. The printing instruction includes information designating object image data representing an object image for printing. The object image data may be a variety of kinds of data, and may be, for example, image data already stored in the memory 215 (for example, the non-volatile memory 230).

In step S110, the processor 210 obtains the object image data designated by the printing instruction. In the present embodiment, bitmap data is used as the object image data. Further, it is presumed that pixel values of respective pixels of the object image data are represented by RGB (R: red, G: green, B: blue) gradation values of 256 gradations from 0 to 256. In a case that the image data designated by the printing instruction is JPEG data, the processor 210 develops the JPEG data to thereby obtain the object image data. In a case that the format of the image data designated by the printing instruction is a format different from the bitmap format (for example, EMF (Enhanced Meta File) format, etc.), the processor 210 uses bitmap data, which is generated by converting (for example, rasterizing) the data format, as the object image data.

In step S150, the processor 210 executes a resolution converting processing of converting the resolution (namely, image density) of the object image data so as to generate an object image data having the resolution determined in advance for the printing. In the following, the pixel(s) having the resolution for the printing is (are) referred to as a print pixel(s). In a case that the resolution of the object image data is same as the resolution for printing, step S150 is omitted.

In step S160, the processor 210 executes a color converting processing of converting the color of the object image data. The color converting processing is a processing of converting the color values (in the present embodiment, the RGB values) of the object image data to color values of an ink color space. The ink color space is a color space corresponding to the colors of plurality of kinds of inks usable in the printing (in the present embodiment, a CMYK color space). The processor 210 refers to a color conversion profile (not depicted in the drawings) indicating the corresponding relationship between the color values of the color space of the object image data and the color values of the ink color space so as to execute the color converting processing. In the present embodiment, the color conversion profile is a lookup table.

In step S170, the processor executes a half tone processing of the object data for which the color conversion has been already executed. The half tone processing may be methods of a variety of kinds of methods, for example, the error diffusion method, a method using dither matrix, etc. The half tone processing generates dot data indicating a state of formation of dot (dot formation state) for each of the color components and for each of the print pixels. The dot formation state is a state of a dot to be formed by the printing; in the present embodiment, the dot formation state is either one of "dot is present (dot formed)" and "dot is absent (no dot formed)". Instead of this, it is allowable that the dot formation state is selected from not less than 3 states including not less than 2 states of "dot is present" of which dot sizes are mutually different (for example, "large-sized dot", "middle-sized dot", "small-sized dot" and "no dot"). In any one of the cases, the dot data indicates a value corresponding to the dot formation state.

In step S180, the processor 210 uses the dot data so as to generate the print data. The print data is data of which format can be interpreted by the control circuit 490 of the printer 400 (FIG. 1). The details of the processing of step S180 will be described later on. In step S190, the processor 210 outputs the print data to the printer 400. In step S195, the control circuit 490 of the printer 400 controls the printer 400 in accordance with the print data to thereby print the image. Then, the processing of FIG. 5 is ended.

Figure 6A:
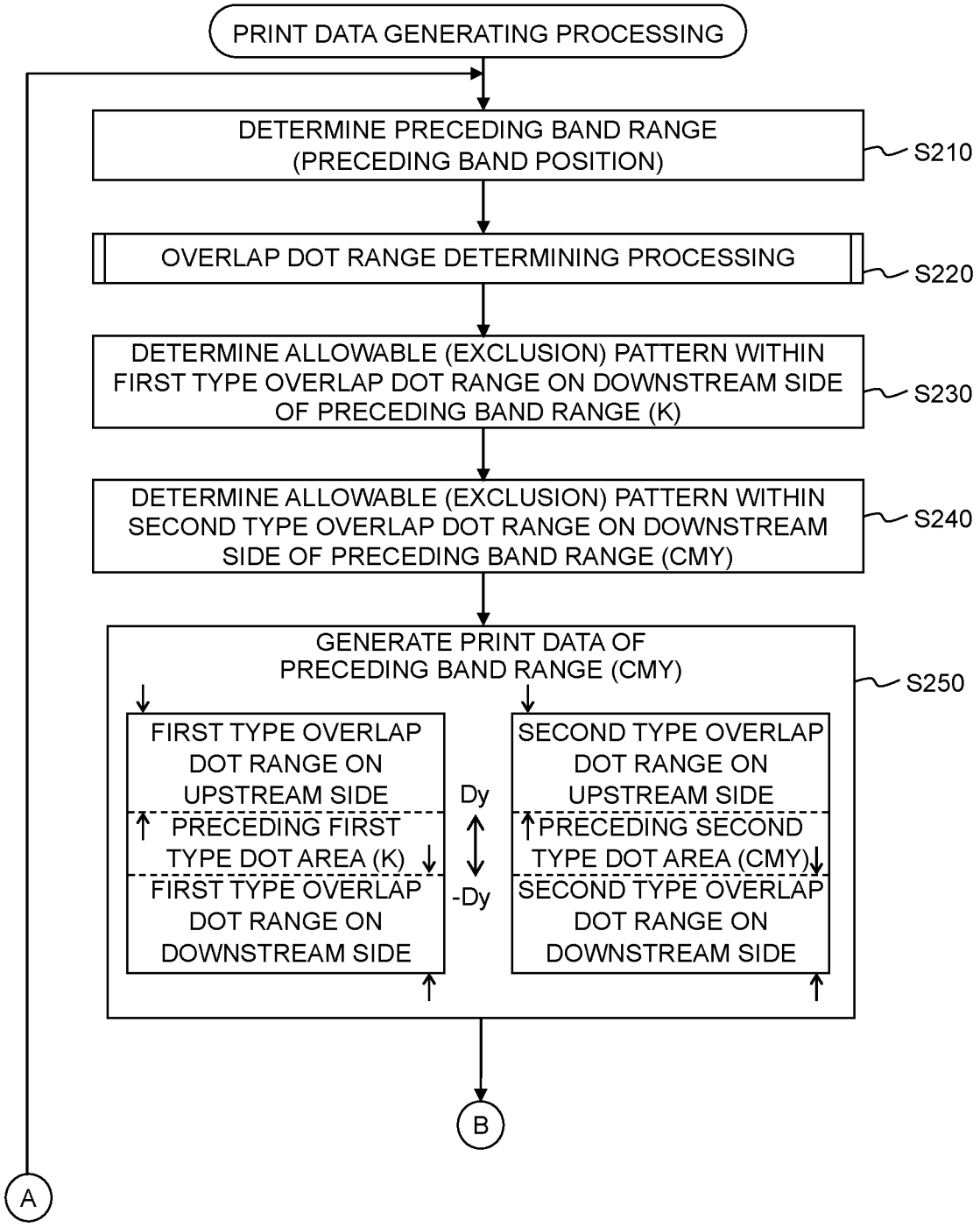
FIGS. 6A and 6B depict a flowchart indicating an example of print data generating processing.
Figure 6B:
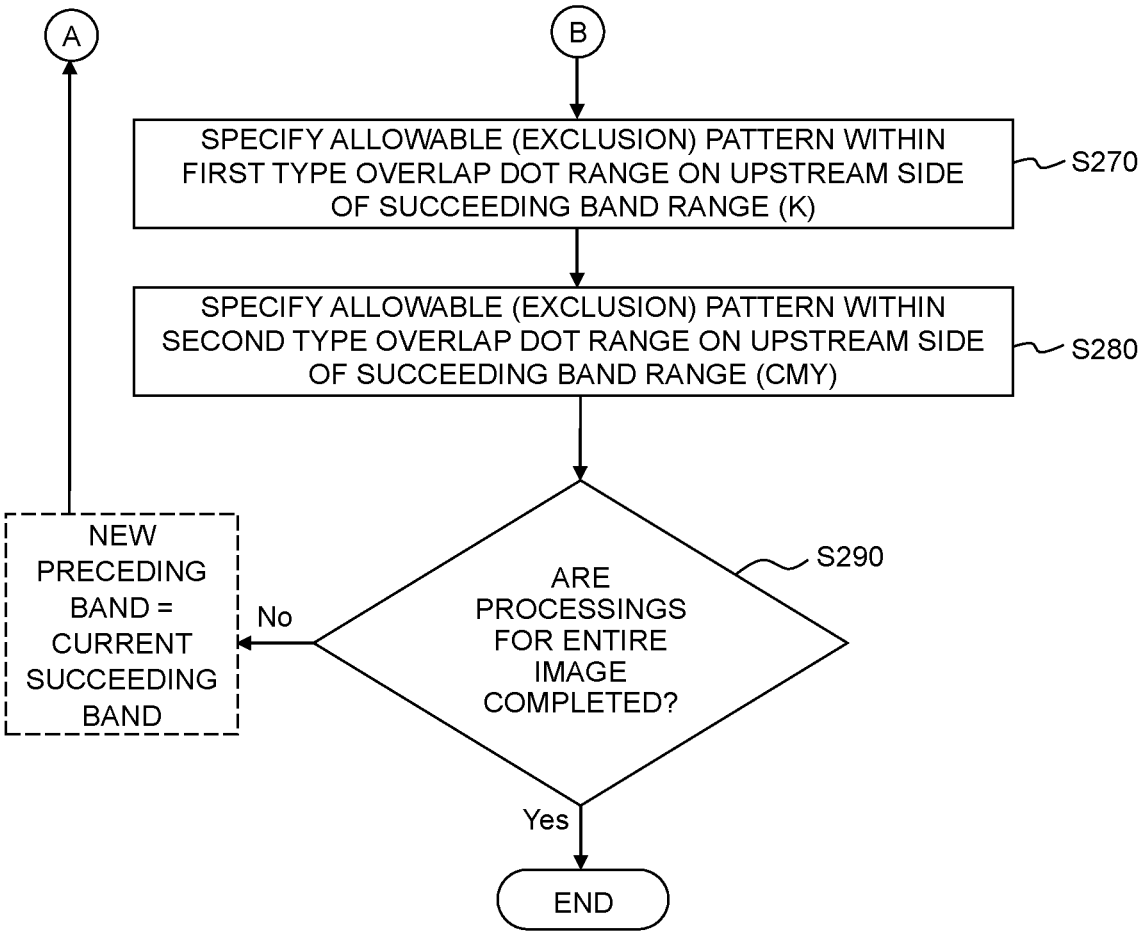

FIGS. 6A and 6B depict a flowchart indicating an example of the print data generating processing. As explained with respect to FIG. 4, the parts of the ranges in the sub scanning direction Dy of the two band images which are adjacent to each other may overlap with each other. The processor 210 selects the two adjacent band images as an object band pair as the band images which are an object of the processing. In the following, among the two band images as the object of the processing, a band image on the upstream side (on the side of the direction +Dy) is referred to as a "preceding band image", or simply as a "preceding band", and a band image on the downstream side (on the side of the direction −Dy) is referred to as a "succeeding band image", or simply as a "succeeding band". As explained with respect to FIG. 4, the plurality of band images are subjected to the printing sequentially in an order from the upstream side (the side of the direction +Dy) to the downstream side (the side of the direction −Dy). The processor 210 moves the object band pair for one (each) band, from the upstream side (the side of the direction +Dy) to the downstream side (the side of the direction −Dy), and repeats processings of step S210 to S280 with respect to the object band pair.

In step S210, the processor 210 determines a preceding band range as the range in the sub scanning direction Dy of the preceding band image. In the example of FIG. 4, in step S210 performed for the first time, the preceding band range is determined to be a first range R1 of the first band image BI1. In step S210 performed for the second time, the preceding band range is determined to be a second range R2 of the second band image BI1 which is adjacent to the first band image BI1 on the downstream side in the sub scanning direction Dy. Note that the dot data (namely, the object image OI) may include a blank area. In a case that a continuous range, of the preceding band range, which includes an end on the upstream side (the side of the direction +Dy) of the preceding band range is constructed only of the blank area, the processor 210 moves the preceding band range toward the downstream side (side of the direction −Dy), so as to skip the blank area. For example, in a case that the preceding band range is the first range R1, and that a continuous range Rb, of the first range R1, which includes an end on the upstream side (the side of the direction +Dy) of the first range R1 is constructed only of the blank area, the processor 210 moves the preceding band range from the first range R1 to a corrected first range R1*x* which is adjacent to the blank range Rb on the downstream side (side of the direction −Dy). As will be described later on, the preceding band range determined in step S220 performed for the second time and thereafter is specified by the processing of step S220 performed before or previously in a series of steps S210 to S280 which are repeatedly performed. The processor 210 adjusts the preceding band range in accordance with a variety of kinds of conditions.

In step S220, the processor 210 executes an overlap dot range determining processing. Firstly, the processor 210 determines a succeeding band range which is a range in the sub scanning direction Dy of the succeeding band image. Further, the processor 210 determines an overlap dot range which is a range in which the range in the sub scanning direction Dy of a dot pattern of the preceding band image and the range in the sub scanning direction Dy of a dot pattern of the succeeding band image overlap with each other. In the present embodiment, a first type overlap dot range which is an overlap dot range of the black K and a second type overlap dot range which is an overlap dot range of the color (any one of C, M and Y) are determined. Such an overlap dot range indicates a part, of the overlap range Ro of FIG. 4, in which the ranges of the dot patterns overlap with each other. For example, in a case that the overlap range Ro includes a plurality of dots of the black K distributed in the entirety of the overlap range Ro, but does not includes the dots of the color, the first type overlap dot range which is same as the overlap range Ro is determined, but the second overlap dot range is not determined (the second type overlap dot range is not formed).

Note that the first type overlap dot range of the black K is an overlap dot range on the downstream side of the preceding band range, and is an overlap dot rang on the upstream side of the succeeding band range. Similarly, the second type overlap dot range of the color is an overlap dot range on the downstream side of the preceding band range, and is an overlap dot rang on the upstream side of the succeeding band range. The details of step S220 will be described later on.

In step S230, the processor 210 specifies a first type preceding allowable pattern, which is an arranging pattern of pixels which is capable of forming the dots of the black K at the time of printing of the preceding band image, within the first type overlap dot range on the downstream side of the preceding band range. Note that in a case that the processor 210 determines, in step S220, that the first type overlap dot range is not to be formed, the processor 210 adopts an arranging pattern which is capable of forming the dots of the black K in all the pixels, respectively, in an area corresponding to the first type overlap dot range which is (to be) omitted.

In step S240, the processor 210 specifies a second type preceding allowable pattern, which is an arranging pattern of pixels which is capable of forming the dots of the color at the time of printing of the preceding band image, within the second type overlap dot range on the downstream side of the preceding band range. Note that in a case that the processor 210 determines, in step S220, that the second type overlap dot range is not to be formed, the processor 210 adopts an arranging pattern which is capable of forming the dots of the color in all the pixels, respectively, in an area corresponding to the second type overlap dot range which is (to be) omitted.

Although the illustration of a plurality of print pixels are omitted in the drawings, the plurality of print pixels are arranged in a grid-like or lattice-like manner along the main scanning direction (direction parallel to the direction Dx) and along the sub scanning direction Dy. The plurality of print pixels of the overlap dot range can be categorized as either one of: a preceding allowable pixel of which dot formation is allowable at the time of printing of the preceding band image; and a succeeding allowable pixel of which dot formation is allowable at the time of printing of the succeeding band image. The first type preceding allowable pattern is an arranging pattern of the preceding allowable pixel of the black K, and the second type preceding allowable pattern is an arranging pattern of the preceding allowable pixel of the color.

In the present embodiment, the preceding allowable pixel and the succeeding allowable pixel are determined in accordance with a predetermined arranging pattern. The arranging pattern may be a various kinds of patterns. For example, the arranging pattern may be a pattern in which the preceding allowable pixel and the succeeding allowable pixel are arranged alternately along the direction Dx and are arranged alternately along the direction Dy. Instead of this, the arranging pattern may be determined such that the density of the preceding allowable pixel becomes to be gradually smaller from the preceding band range toward the succeeding band range, and that the density of the succeeding allowable pixel becomes to be gradually smaller from the succeeding band range toward the preceding band range. Alternatively, among a plurality of color components, the arranging pattern may be different. Still alternatively, among a plurality of color components, the arranging pattern may be common. In the present embodiment, the processor 210 specifies the first type preceding allowable pattern and the second type preceding allowable pattern in accordance with a first type arranging pattern for the black K and a second type arranging pattern for the color, respectively.

Note that the succeeding allowable pixel is a pixel which is excluded from a candidate of the dot formation at the time of printing of the preceding band image (also referred to as a "preceding exclusion pixel"). Specifying the arranging pattern of the preceding allowable pixel is same as specifying the arranging pattern of the preceding exclusion pixel. Namely, it is possible to also consider that each of steps S230 and S240 specifies the arranging pattern of the preceding exclusion pixel.

In step S250, the processor 210 generates print data of the preceding band range. The print data indicates, with respect each of the CMYK, a distribution area of pixels in which the dots are to be formed (also referred to as "dot pixels"), namely indicates the dot area in which the liquid droplets of the ink (ink droplets) are to be discharged or ejected. Further, the print data determines a corresponding relationship between the dot pixels and a conveying amount of the conveying processing which is performed between the passes of the not less than one time of the pass. In the following, a dot area of the black K is also referred to as a first type dot area; and a dot area of the color (any one of CMY) is also referred to as a second type dot area.

With respect to the print data of the black K, the following is performed. Namely, regarding a part, of the preceding band image, which is not included in the overlap range, the processor 210 adopts an arrangement of the dots of the black K which is indicated by the dot data (FIG. 5: step S170) as it is, as a distribution area of pixels in which the dots of the black K are to be formed.

In step S220, in a case that the processor 210 determines that the first type overlap dot range on the downstream side (the side of the sub scanning direction −Dy) is not to be formed, the processor 210 adopts an arrangement of the dots of the black K which is indicated by the dot data as it is, as a distribution area of pixels in which the dots of the black K are to be formed, in a range corresponding to the first type overlap dot area which is (to be) omitted.

In step S220, in a case that the processor 210 determines that the first type overlap dot range on the downstream side (the side of the sub scanning direction −Dy) is to be formed, the processor 210 applies the first type preceding allowable pattern specified in step S230 to the arrangement of the black K indicated by the dot data, with respect to a part included in the first type overlap dot range on the downstream side. With this, the processor 210 determines a distribution area of the pixels in which the dots of the black K are to be formed at the time of printing of the preceding band image.

With respect to the first type overlap dot range on the upstream side (+Dy), as will be described later on, it is determined as to whether or not the first type overlap dot range is to be provided, in step S220 performed the last time (previous time) in the series of steps S210 to S280 which are repeatedly performed. Then, in step S270 performed the last time in the series of steps S210 to S280 which are repeatedly performed, the allowable pattern of the black K is specified, and in step S280 performed the last time in the series of steps S210 to S280 which are repeatedly performed, the allowable pattern of the color is specified.

In a case that the processor 210 determines, in step S220 performed the last time in the series of steps S210 to S280 which are repeatedly performed, that the first type overlap dot range on the upstream side (+Dy) is not to be provided, the processor 210 adopts the arrangement of the dots of the black K which is indicated by the dot data as it is, as the distribution range of pixels in which the dots of the black K are to be formed, in the range corresponding to the first type overlap dot area which is (to be) omitted. In a case that the processor 210 determines, in step S220 performed the last time, that the first type overlap dot range on the upstream side (+Dy) is to be provided, the processor 210 applies the allowable pattern of the black K specified in step S270, as the arrangement of the black K indicated by the dot data. With this, the processor 210 determines the distribution area of the pixels in which the dots of the black K are to be formed at the time of printing of the preceding band image.

As described above, the processor 210 determines the distribution area of the pixels in which the dots of the black K are to be formed, respectively, over the entirety of the preceding band range. Further, the processor 210 determines, based on the result of the processing of step S220, the corresponding relationship between the dot pixels and the conveying amount of the conveying processing which is performed between the passes of the not less than one time of the pass (the details of which will be described later on).

The processor 210 determines also a distribution area of the pixels in which the dots of the color inks (CYM) are to be formed, respectively, in a similar manner regarding the dots of the black K. Regarding a part, of the preceding band area, which is not included in the overlap range, the processor 210 adopts an arrangement of the dots which is indicated by the dot data (FIG. 5: step S170) as it is, as a distribution area of pixels in which the dots are to be formed. In a case that the processor 210 determines, in step S220, that the second type overlap dot range on the downstream side (−Dy) is to be provided, the processor 210 applies, regarding a part included in the second type overlap dot range, the second type preceding allowable pattern specified in step S240 as it is, to the arrangement of the dos indicated by the dot data. With this, the processor 210 determines the distribution area of the pixels in which the dots are to be formed, respectively, at the time of printing of the preceding band image. With respect to the second type overlap dot range on the upstream side (+Dy), the processor 210 determines, as will be described later on, as to whether or not the second type overlap dot range on the upstream side (+Dy) is to be provided, in step S220 performed the last time in the series of steps S210 to S280 which are repeatedly performed. Further, in a case that the processor 210 determines that the second type overlap dot range on the upstream side (+Dy) is to be provided, the allowable pattern of the color is specified in step S280 performed the last time in the series of steps S210 to S280 which are repeatedly performed. The processor 210 applies this allowable pattern of the color to the dot data to thereby determine the distribution area of the pixels in which the dots are to be formed, respectively, at the time of printing of the preceding band image. Further, the processor 210 determines, based on the result of the processing of step S220, the corresponding relationship between the dot pixels and the conveying amount of the conveying processing which is performed between the passes of the not less than one time of the pass (the details of which will be described later on).

Then, the processor 210 generates the print data of the preceding band range in accordance with the distribution area of the pixels in which the dots of the respective CMYK inks are to be formed, respectively, and the corresponding relationship between the pixels and the passes.

In step S270, the processor 210 specifies a first type succeeding allowable pattern which is an arranging pattern of pixels which is capable of forming the dots of the black K at the time of printing of the succeeding band image, within the first type overlap dot range on the upstream side of the succeeding band range. Note that in a case that the processor 210 determines, in step S220, that the first type overlap dot range is not to be formed, the processor 210 adopts an arranging pattern which is capable of forming the dots of the black K in all the pixels, respectively, in an area corresponding to the first type overlap dot range which is (to be) omitted. In step S280, the processor 210 specifies a second type succeeding allowable pattern, which is an arranging pattern of pixels which is capable of forming the dots of the color at the time of printing of the succeeding band image, within the second type overlap dot range on the upstream side of the succeeding band range. Note that in a case that the processor 210 determines, in step S220, that the second type overlap dot range is not to be formed, the processor 210 adopts an arranging pattern which is capable of forming the dots of the color in all the pixels, respectively, in an area corresponding to the second type overlap dot range which is (to be) omitted.

Note that the preceding allowable pixel is a pixel which is excluded from a candidate of the dot formation at the time of printing of the succeeding band image (also referred to as a "succeeding exclusion pixel"). Specifying the arranging pattern of the succeeding allowable pixel is same as specifying the arranging pattern of the succeeding exclusion pixel. Namely, it is possible to also consider that the processor 210 specifies, in each of steps S270 and S280, the arranging pattern of the succeeding exclusion pixel.

Note that as described above, the processor 210 moves the object band pair for one (each) band, from the upstream side (the side of the direction +Dy) to the downstream side (the side of the direction −Dy), and repeats processings of step S210 to S280 with respect to the object band pair. The print data of the succeeding band range is generated, in step S250 performed the next time, as the print data for a new preceding band range. In such a manner, the processor 210 generates, in step S250 performed the next time, the print data of the succeeding band range in accordance with the distribution area of the pixels in which the dots of the respective CMYK inks are to be formed, respectively, and the corresponding relationship between the pixels and the passes.

In step S290, the processor 210 determines as to whether or not processings for the entire object image OI are completed. In a case that any part which has not been processed remains (step S290: NO), the processor 210 proceeds to step S210. Here, the current succeeding band image is used as a new preceding band image. Note that the print data of the preceding band range generated in step S250 is also referred to as a "first data". In step S250 performed the next time, the print data of the succeeding band range is generated as the print data of a new preceding band range (also referred to as a "second data").

In a case that the processings of the entire object image OI are completed (step S290: YES), the processor 210 ends the processings of FIGS. 6A and 6B, and consequently the processing of step S180 of FIG. 5.

Figure 7A:
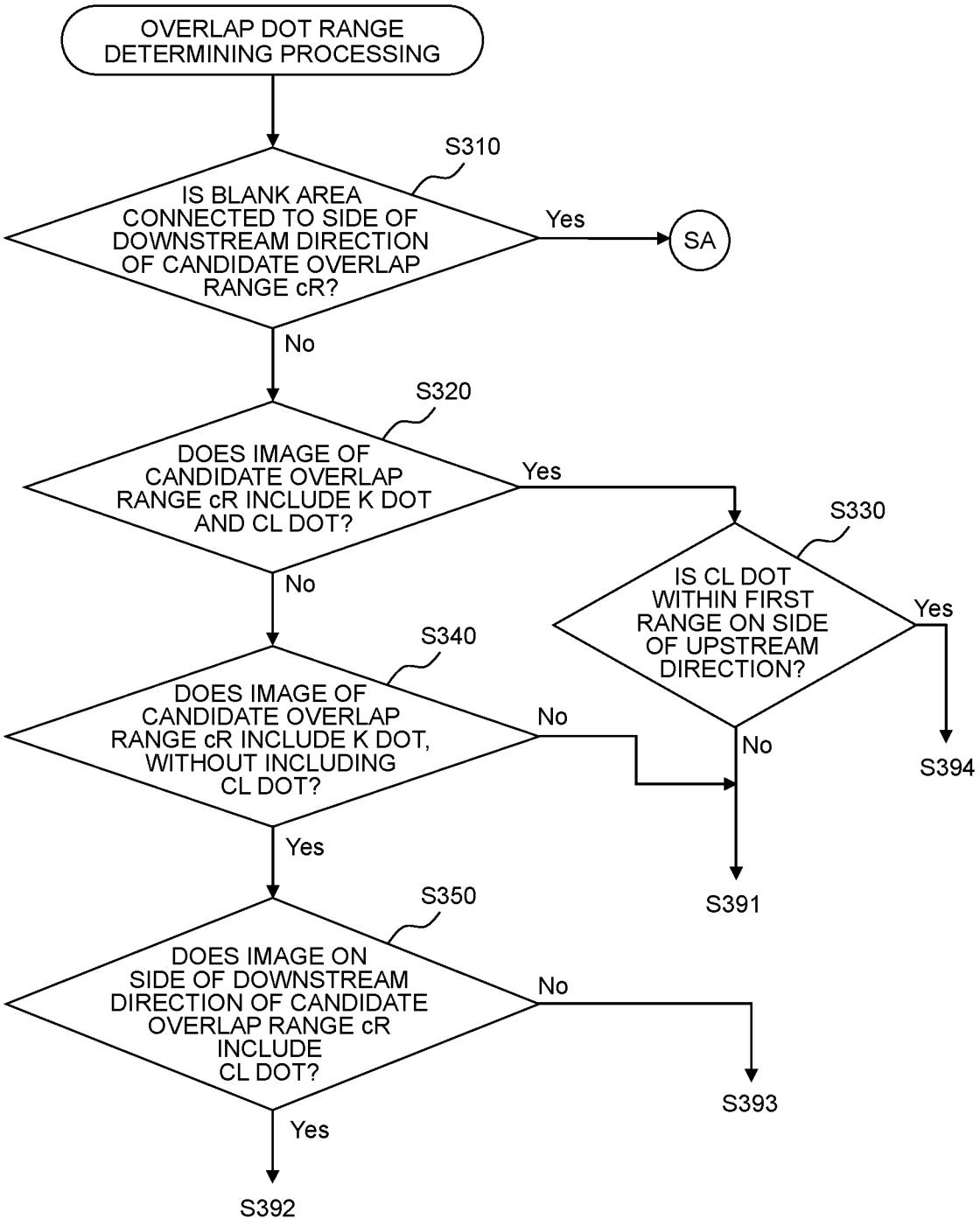
FIGS. 7A and 7B depict a flowchart indicating an example of the print data generating processing.
Figure 7B:
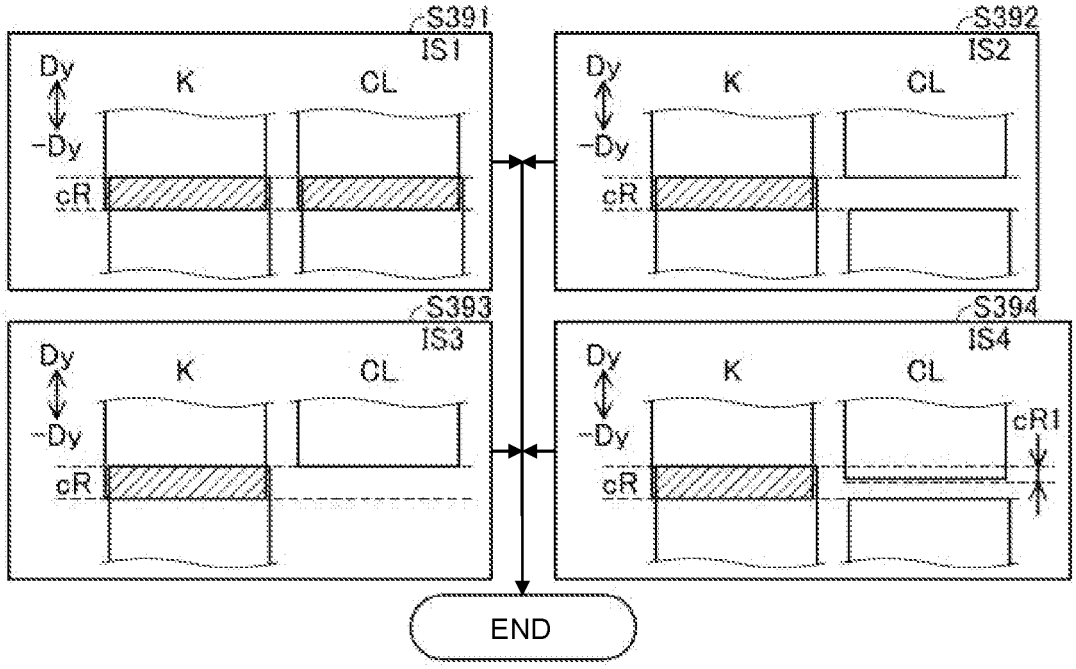
Figure 8:
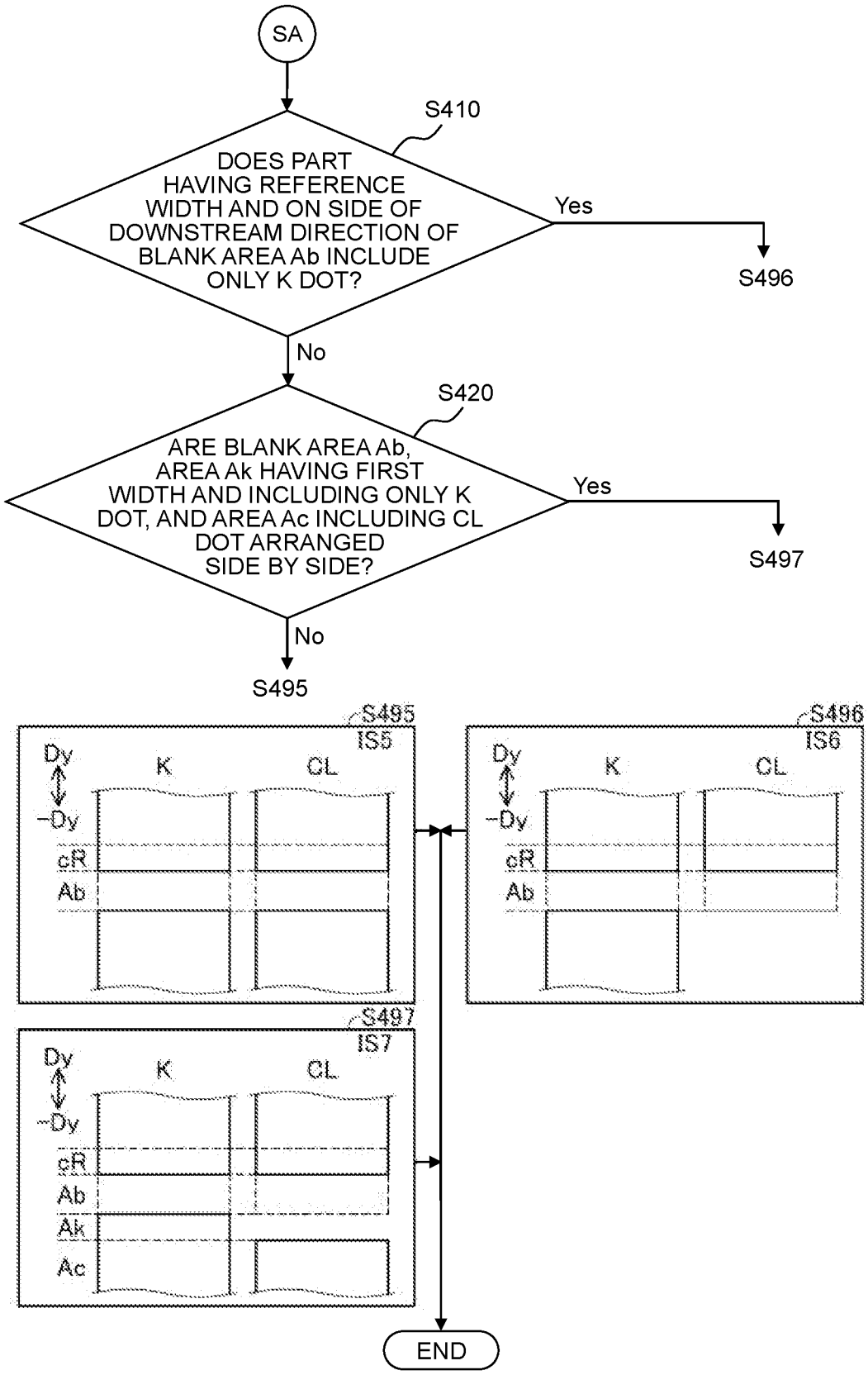
FIG. 8 depicts a flowchart indicating an example of an overlap dot range determining processing.

FIGS. 7 and 8 are each a flowchart indicating an example of the overlap dot range determining processing (FIG. 6A: step S220). FIG. 8 depicts a processing following from the processing in FIGS. 7A and 7B. In the present embodiment, the processor 210 determines a relationship between the pass and the positions in the sub scanning direction Dy of the nozzles NZ, in addition to the succeeding band range and the overlap dot range. In the processings of FIGS. 7 and 8, the relationship between the pass and the positions of the nozzles are selected among seven kinds of relationships IS1 to IS7.

Figure 9:
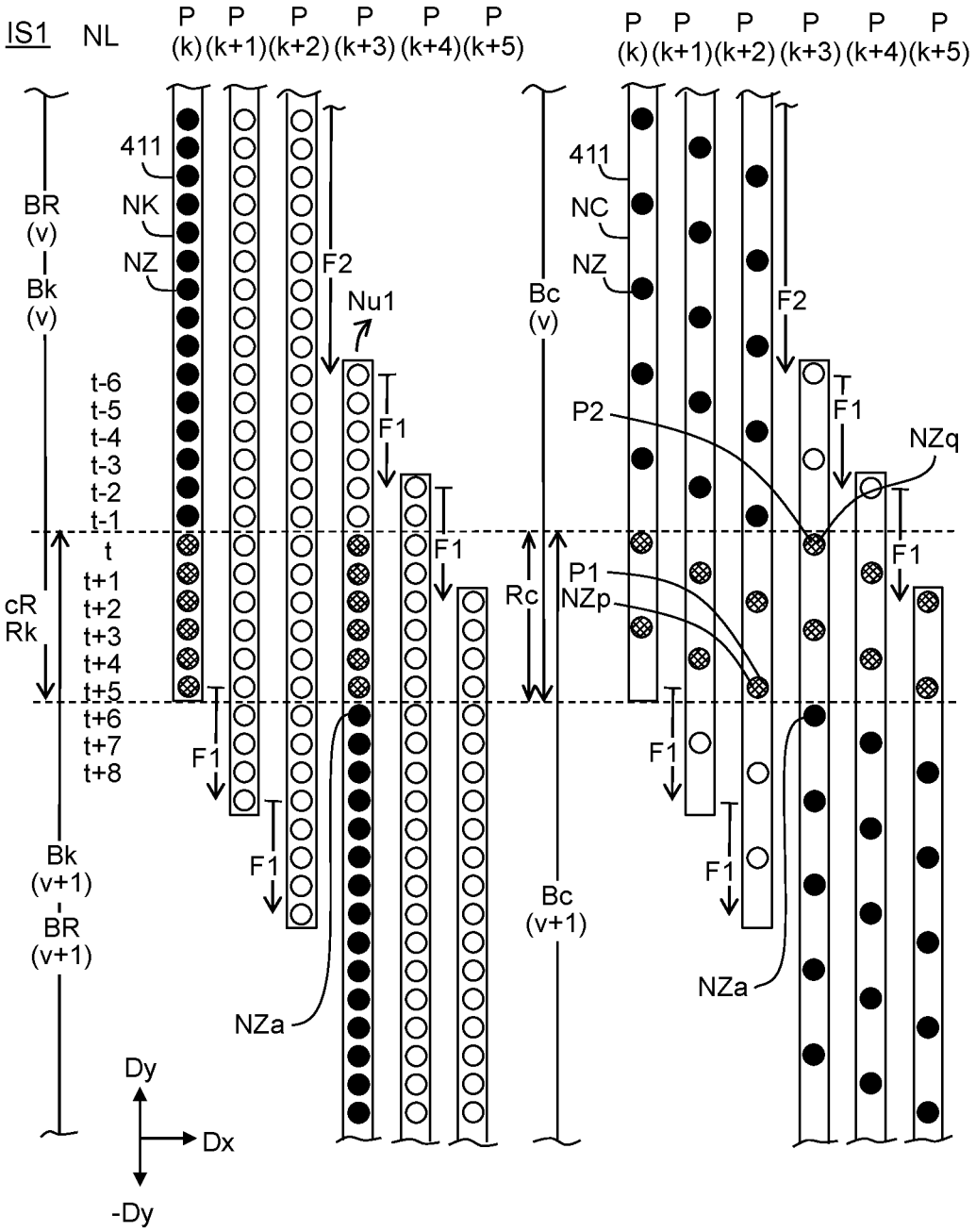
FIG. 9 is a view for explaining a pass and positions in a sub scanning direction Dy of nozzles.

FIGS. 9 to 17 are each a view for explaining the pass and a position in the sub scanning direction Dy of the nozzle. In each of FIGS. 9 and 17, the lateral direction is the main scanning direction (direction parallel to the direction Dx) and the up direction (toward the upper side in the sheet surface of the drawings) is the sub scanning direction Dy. FIG. 9 depicts the first relationship IS1. FIG. 9 depicts ranges in the sub scanning direction DY of a v-th (v being an integer) band range BR(v) and a v+1-th band range BR(v+1), respectively. The v-th (v being an integer) band range BR(v) is a preceding band range, and the v+1-th band range BR(v+1) is a succeeding band range.

In the drawings, positions in the sub scanning direction Dy of the nozzle groups NK and NC in each of six passes which are k-th (k being an integer) pass P(k) to k+5-th pass P(k+5) are indicated. The nozzle group NK of the black K is indicated on the left side, and the nozzle group NC of the cyan C is indicated on the right side. Circular marks, specifically a black (solid) circular mark, a while circular mark and a hatched circular mark represent the nozzles NZ, respectively. Reference numerals t−6-th (t being an integer)

to t+8-th represent line numbers NL, respectively. The line numbers NL are identification numbers of print pixel lines, respectively, extending in the main scanning direction, and are designated to the print pixel lines in an ascending manner toward the direction −Dy.

In the present embodiment, the resolution in the sub scanning direction Dy of the print pixels is same as resolution in the sub scanning direction Dy of the nozzles NZ of the black K (namely, the pitch NPa). Accordingly, in a case that the second nozzle pitch NPb of the nozzles NZ of the color ink (for example, of the cyan C) is represented by the number of the print pixels, the second nozzle pitch NPb is same as the "F" (in the present embodiment, F=3). The nozzles NZ of the cyan C are arranged in such a ratio that one piece of the nozzle NZ of the cyan C is arranged per every F pieces of the image pixels arranged side by side in the sub scanning direction Dy.

One piece of the nozzle NZ is capable of performing printing of one print pixel line extending in the main scanning direction. A nozzle NZ of the black (solid) circular mark is a nozzle NZ which performs printing of all the dots in one piece of the print pixel line. A nozzle NZ of the white circular mark is a nozzle NZ which does not form any ink dots. A hatched nozzle NZ is a nozzle NZ which forms a dot(s) in not less than 1 print pixel in a part of a plurality of print pixels in a print pixel line corresponding to the hatched nozzle NZ.

A v-th dot range Bk(v) regarding the black K is a range in the sub scanning direction Dy of an area in which dots of the black K are formed at the time of printing of a band image in a v-th band range BR(v) (also referred to as a "preceding first type dot range Bk(v)). A v+1-th dot range Bk(v+1) regarding the black K is a range in the sub scanning direction Dy of an area in which dots of the black K are formed at the time of printing of a band image in a v+1-th band range BR(v+1) (also referred to as a "succeeding first type dot range Bk(v+1)).

Similarly, a v-th dot range Bc(v) regarding the cyan C is a range in the sub scanning direction Dy of an area in which dots of the cyan C are formed at the time of printing of a band image in a v-th band range Bc(v) (also referred to as a "preceding second type dot range BR(v)). A v+1-th dot range Bc(v+1) regarding the cyan C is a range in the sub scanning direction Dy of an area in which dots of the cyan C are formed at the time of printing of a band image in a v+1-th band range BR(v+1) (also referred to as a "succeeding second type dot range Bc(v+1)).

In step S310 of FIG. 7A, the processor 210 refers to the dot data, and determines as to whether or not a blank area is connected to the downstream side (side of the direction of −Dy) of the preceding band range BR(v). In a case that any blank area is not connected to the downstream side of the preceding band range BR(v) (step S310: NO), the processor 210 determines, in step S320, as to whether or not an image of a candidate overlap range cR includes both of a dot of the black K and a dot of the color (any one of C, M and Y).

FIG. 9 depicts an example of the candidate overlap range cR. In the present embodiment, the candidate overlap range cR is a range having a predetermined width and including an end on the downstream side of the preceding band range BR(v). In the present embodiment, the width in the sub scanning direction Dy of the candidate overlap range cR is an integer time (integral multiple of) the second nozzle pitch NPb (FIG. 3). As depicted in FIG. 9, in the present embodiment, the candidate overlap range cR is constructed of 6 pieces of the pixel line (in FIG. 9, 6 pieces of pixel lines which are t-th to t+5-th pixel lines). Namely, the width of the candidate overlap range cR is two times the second nozzle pitch NPb.

In a case that a result of the determination in step S320 is YES, then the processor 210 determines, in step S330, as to whether or not the dot of the color within the candidate overlap range cR is within a first range on the upstream side (side of the direction +Dy) in the candidate overlap range cR. In the present embodiment, the first range is a half part, of the candidate overlap range cR, which is on the upstream side (side of the direction +Dy) in the candidate overlap range cR. In case that a result of the determination in step S330 is NO, then the processor 210 determines, in step S391, the succeeding band range, the overlap dot range and the relationship between the pass and the positions in the sub scanning direction Dy of the nozzles in accordance with the first relationship IS1. Then, the processor 210 ends the processing of FIGS. 7A and 7B.

FIG. 9 is a view explaining the first relationship IS1. In a case that the first relationship IS1 is adopted, the image of the preceding band range BR(v) is printed by three times of passes which are passes P(k), P(k+1) and P(k+2). The image of the succeeding band range BR(v+1) is printed by three times of passes which are passes P(k+3), P(k+4) and P(k+5) which follow three times of the pass which are the passes P(k), P(k+1) and P(k+2).

A dot range Bk(v) of the black K is a range in the sub scanning direction Dy of an area in which the dots of the black K are formed at the time of printing of the image of the preceding band range BR(v) (also referred to as a "preceding first type dot range Bk(v)). A dot range Bk(v+1) of the black K is a range in the sub scanning direction Dy of an area in which the dots of the black K are formed at the time of printing of the image of the succeeding band range BR(v+1) (also referred to as a "succeeding first type dot range Bk(v+1)). The first type overlap dot range Rk is a part in which the preceding first type dot range Bk(v) and the succeeding first type dot range Bk(v+1) overlap with each other. The first type overlap dot range Rk is selected from the candidate overlap range cR. In the first relationship IS1 of FIG. 9, the first type overlap dot range Rk is same as the candidate overlap range cR.

Similarly, a dot range Bc(v) of the cyan C is a range in the sub scanning direction Dy of an area in which the dots of the cyan C are formed at the time of printing of the image of the preceding band range BR(v) (also referred to as a "preceding second type dot range Bc(v)). A dot range Bc(v+1) of the cyan C is a range in the sub scanning direction Dy of an area in which the dots of the cyan C are formed at the time of printing of the image of the succeeding band range BR(v+1) (also referred to as a "succeeding second type dot range Bc(v+1)). The second type overlap dot range Rc is a part in which the preceding second type dot range Bc(v) and the succeeding second type dot range Bc(v+1) overlap with each other. The second type overlap dot range Rc is selected from the candidate overlap range cR. In the first relationship IS1 of FIG. 9, the second type overlap dot range Rc is same as the candidate overlap range cR.

Firstly, the cyan C will be explained. A first conveying amount F1 in FIG. 9 is a conveying amount of each of two times of conveyance among the three times of the pass (three passes) by which one piece of band image is printed. The first conveying amount F1 is relatively prime to the nozzle pitch NPb represented by the pixel number (in the example depicted in FIG. 9, NPb=F=3, F1=4). Accordingly, the nozzle group NC of the cyan C is capable of forming dots in mutually different pixel lines by three times of the pass.

Further, the number of times of the pass (three times) is same as the nozzle pitch NPb represented by the pixel number. Accordingly, the nozzle group NC is capable of forming the dots, without any spacing distances therebetween, in a plurality of pixel lines which are continuous in the sub scanning direction Dy. In the present embodiment, the nozzle group NC prints a plurality of pixel lines, which are not included in the second type overlap dot range Rc, by performing three times of passe in a dividing manner (one piece of the pixel lines is printed by one time of the pass).

Regarding the second type overlap dot range Rc, all the pixel lines are printed by two times of the pass in the dividing manner. For example, dots of the cyan C in the t+1-th pixel line is printed in a dividing manner by a k+1-th pass P(k+1) and a k+4-th pass P(k+4). A second conveying amount F2 in the FIG. 9 is a conveying amount between the pass P(k+2) which is the last pass for the preceding band range BR(v) and the pass P(k+3) which is the first pass for the succeeding band range BR(v+1). The second conveying amount F2 and the candidate overlap range CR are determined so that all the pixel lines in the candidate overlap range cR can be printed by the two times of the pass in the dividing manner.

As described above, the nozzle group NC is capable of printing the plurality of pixel lines which are continuous in the sub scanning direction Dy by the pass which is performed in a number of times same as the nozzle pitch NPb represented by the pixel number. However, an area overlapping with an end part of the nozzle group NC includes a pixel line which cannot be printed. For example, in the example of FIG. 9, a t+6-th pixel line on the side of −Dy of the nozzle NZp in the k+2-th pass P(k+2) cannot be printed by the three times of the passes P(k), P(k+1) and P(k+2). On the side of the direction +Dy from a first position P1 of the nozzle NZp of the pass P(k+2), it is possible to perform printing of a plurality of pixel lines, which are continuous, by the three times of the passes P(k), P(k+1) and P(k+2). Similarly, a t−1-th pixel line on the side of +Dy of a nozzle NZp in the k+3-th pass P(k+3) cannot be printed by the three times of the passes P(k+3), P(k+4) and P(k+5). On the side of the direction −Dy from a second position P2 of a nozzle NZq of the pass P(k+3), it is possible to perform printing of a plurality of pixel lines, which are continuous, by the three times of the passes P(k+3), P(k+4) and P(k+5).

In the example depicted in FIG. 9, the second conveying amount F2 is determined so as to satisfy the following condition C1.

(Condition C1): The first position P1 in the sub scanning direction Dy of the nozzle NZp in the k+2-th pass P(k+2) is on the −Dy side relative to the second position P2 in the sub scanning direction Dy of the nozzle NZq in the k+3-th pass P(k+3).

In a case that the condition C1 is satisfied, by adopting, as the candidate overlap range cR, at least a part of the range from the first position P1 to the second position P2, it is possible to print all the pixel lines in the candidate overlap range cR by the two times of the pass in the dividing manner. Note that in the present embodiment, the second conveying amount F2 is determined so as to further satisfy the following conditions C2 and C3.

(Condition C2): The total number (in FIG. 9: 6 (six)) of the pixel lines included in the range from the first position P1 to the second position P2 is an integral multiple of the nozzle pitch NPb represented by the pixel number (in FIG. 9: 3 (three)).

(Condition C3): The entirety of the range from the first position P1 to the second position P2 is adopted as the overlap range Ro.

With these as described above, the arrangement of the nozzles NZ on the upstream side (on the side of the direction +Dy) of the candidate overlap range cR in the preceding three passes P(k), P(k+1) and P(k+2) is symmetrical to the arrangement of the nozzles NZ on the downstream side (on the side of the direction −Dy) of the candidate overlap range cR in the succeeding three passes P(k+3), P(k+4) and P(k+5). Accordingly, in each of the preceding three times of passes P(k), P(k+1) and P(k+2) and the succeeding three times of passes P(k+3), P(k+4) and P(k+5) following thereafter, the corresponding relationship between a pixel line and the pass which prints said pixel line can be determined in a similar rule. For example, the t−1-th pixel line which is adjacent to the upstream side of the candidate overlap range cR is printed by the last pass P(k+2) among the tree passes which are the passes P(k), P(k+1) and P(k+2), and the t+6-th pixel line which is adjacent to the downstream side of the candidate overlap range cR is printed by the first pass P(k+3) among the tree passes which are the passes P(k+3), P(k+4) and P(k+5).

The foregoing explanation regarding the cyan C is similar also regarding the magenta M and the yellow Y.

Next, the black K will be explained. In the present embodiment, the dots of the black K in each of the band images are printed by the first pass among the three passes. For example, the dots of the black K in the preceding band range BR(v) are printed by the k-th pass. In the two times of passe which are the pass P(k+1) and the pass P(k+2) following the pass P(k), the dots of the black K are not formed. The dots of the black K in the succeeding band range BR(v+1) is printed by the k+3th pass P(k+3). In the two times of passe which are the pass P(k+4) and the pass P(k+5) following the pass P(k+3), the dots of the black K are not formed. A plurality of dots of the black K of a pixel line which is not included in the first type overlap dot range Rk is printed by one time of the pass. A plurality of dots of the black K of a pixel line which is included in the first type overlap dot range Rk is printed by two times of the pass which are the k-th pass P(k) and the k+3-th pass P(k+3) in a dividing manner.

In a case that the first relationship IS1 is repeated, a range from the overlap dot range to a next overlap dot range forms one piece of the band range BR. One piece of the band range BR includes the overlap dot ranges on the both ends. The width in the sub scanning direction Dy of such a band range BR is also referred to as a "band reference width".

As described above, in the example of FIG. 9, in the overlap dot ranges Rk and Rc (more generally, in the candidate overlap range cR), regarding all the inks of CMYK, all the pixel lines are printed by two times of the passes in a dividing manner. Accordingly, any deficiency or fault in a printed color (for example, a white streak, unevenness in density) can be suppressed in the overlap dot range. Further, among the plurality of nozzles NZ in the nozzle groups NK and NC, any nozzles NZ which are positioned outside beyond the overlap dot range are not used in the printing. For example, in k-th pass P(k), the nozzles NZ of the black K corresponding from the t+6-th to t+8-th pixel lines are not used in the printing. Generally, a nozzles NZ which is located at an end of a nozzle group are affected by any deviation in the position such as the vibration of the head unit 410, etc., to a greater extent than another nozzle NZ which is located at the center in the nozzle group. In the present embodiment, the formation of the dot by the nozzle NZ located at the end of the nozzle group is suppressed. Accordingly, any deficiency or fault in the printed color (for example, a white streak, unevenness in density), due to any deviation in the position of the head unit 410, etc., can be suppressed.

Further, in the present embodiment, the resolution in the sub scanning direction Dy of the dot pattern in each of the preceding band range BR(v) and the succeeding band range BR(v+1) is same as the resolution corresponding to the nozzle pitch NPa in the nozzle group NK of the black K (FIG. 3). Furthermore, the first overlap dot range Rk is constructed of 6 pieces of the pixel line. The total number (6) of the pixel lines is a value obtained by multiplying a ratio F (here, 3) of the second nozzle pitch NPb of the color relative to the first nozzle pitch NPa of the black K by an integer which is not less than 1 (here, 2). Moreover, a length corresponding to the first conveying amount F1 (4) between the first pass P(k+3) and the second pass p(k+4) among the three passes for the printing of the succeeding band range BR is greater than the second nozzle pitch NPb. Accordingly, a plurality of dot lines which are formed by a same nozzle of the black K are not continued. As a result, in a case that a nozzle of the black K has any inconvenience (for example, clogging, etc.), any continuation of a line of inappropriate dots (inappropriate dot line) is suppressed, thereby making it possible to suppress any lowering in the print quality of an image to be printed.

Note that the first relationship IS1 has the following characteristic, as well. In the first pass P(k+3) for the printing of the succeeding band range BR(v+1), the number of the nozzles of the black K which are located on the side of the sub scanning direction Dy relative to the first type overlap dot range Rk is 6 (six), and is a multiple of the ratio F (3) (here, two times of 3 (three)). Further, the conveyor 440 performs the conveying processing by the first conveying amount F1 between the first pass P(k+3) and the second pass P(K+4). In the second pass P(k+4), the number of the nozzles of the black K which are located on the side of the sub scanning direction Dy relative to the first type overlap dot range Rk is 2 (two). In such a manner, in the conveying processing, the position of the paper sheet PM is moved from a first paper sheet position at which the number of the nozzles NZ of the black K on the side of the sub scanning direction Dy relative to the first overlap dot range Rk is the multiple of "F" to a second paper sheet position at which the number of the nozzles NZ of the black K on the side of the sub scanning direction Dy relative to the first overlap dot range Rk is smaller than a number obtained by subtracting F pieces from the number of the nozzles NZ of the black K at the first paper sheet position. With this, in a case that a nozzle of the black K has any inconvenience (for example, clogging, etc.), any continuation of a line of inappropriate dots (inappropriate dot line) is suppressed, thereby making it possible to suppress any lowering in the print quality of an image to be printed.

Note that in a case that the processor 210 determines in step S220 (FIG. 6A) that the overlap dot range is not to be formed, the processor 210 determines the relationship between the pass and the nozzle(s) so that an area corresponding to an overlap dot range Which is to be omitted (in the present embodiment, the candidate overlap range cR) is printed in a similar manner as an area located on the outside of the candidate overlap range cR.

Figure 10:
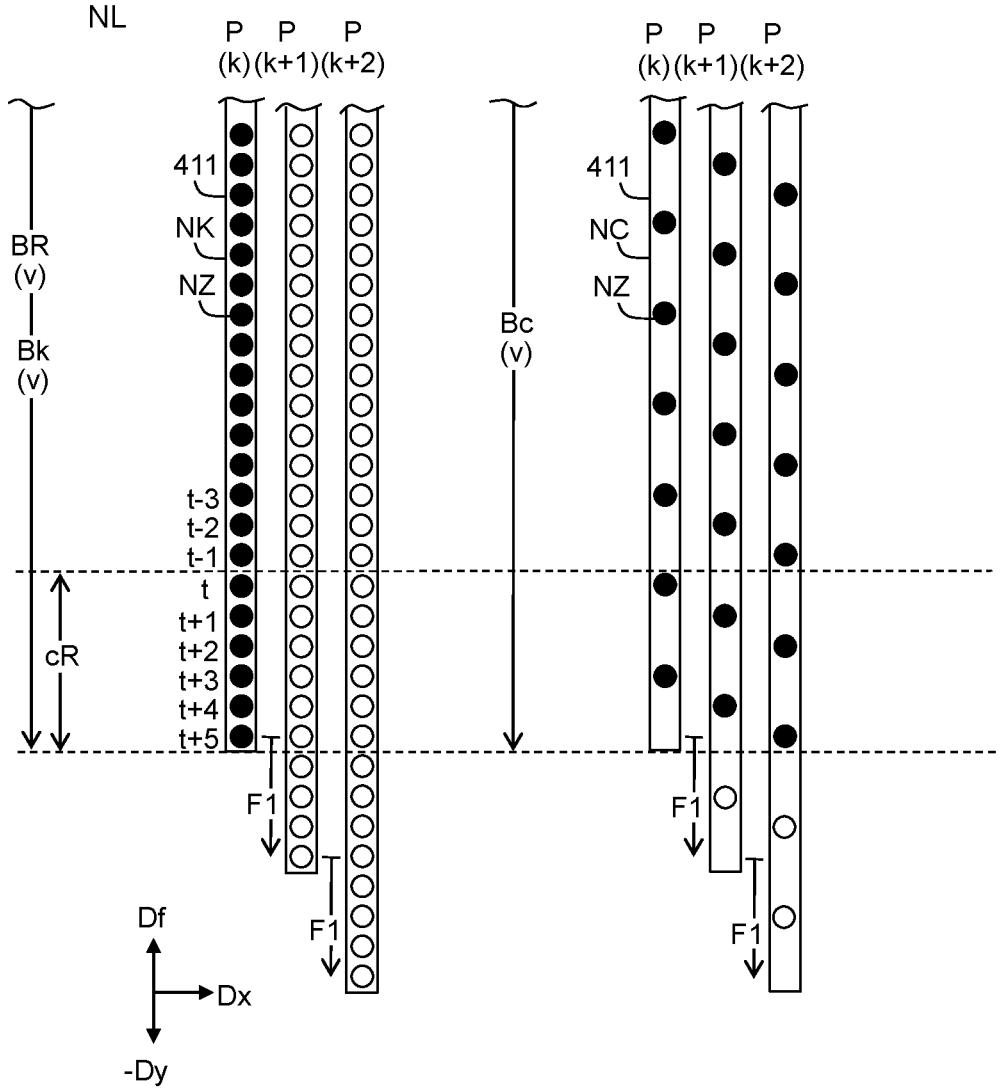
FIG. 10 is a view for explaining the pass and the positions in the sub scanning direction Dy of the nozzles.

FIG. 10 is a view for explaining the pass and the positions in the sub scanning direction Dy of the nozzles in a case that the overlap dot range on the downstream side (−Dy) is not provided. FIG. 10 indicates a v-th dot range Bk(v), a v-th dot range Bc(v), and the arrangement of the nozzle groups NK and NC in each of the three passes P(k), P(k+1) and P(k+2) which are same as those in FIG. 9. FIG. 10 indicates a case wherein the overlap dot ranges Rk and Rc on the downstream side (−Dy) of the v-th dot ranges Bk(v) and Bc(v) are not provided. In the t-th to t+5-th pixel lines of areas corresponding to the omitted overlap dot ranges Rk and Rc, respectively, (in the present embodiment, an area of the candidate overlap range cR), the dots of the black K are printed by the first pass P(k) among the three passes P(k), P(k+1) and P(k+2), and the dots of the cyan C are printed by the three passes P(k), P(k+1) and P(k+2) (one piece of the pixel line is printed by one time of the pass).

Figure 11:
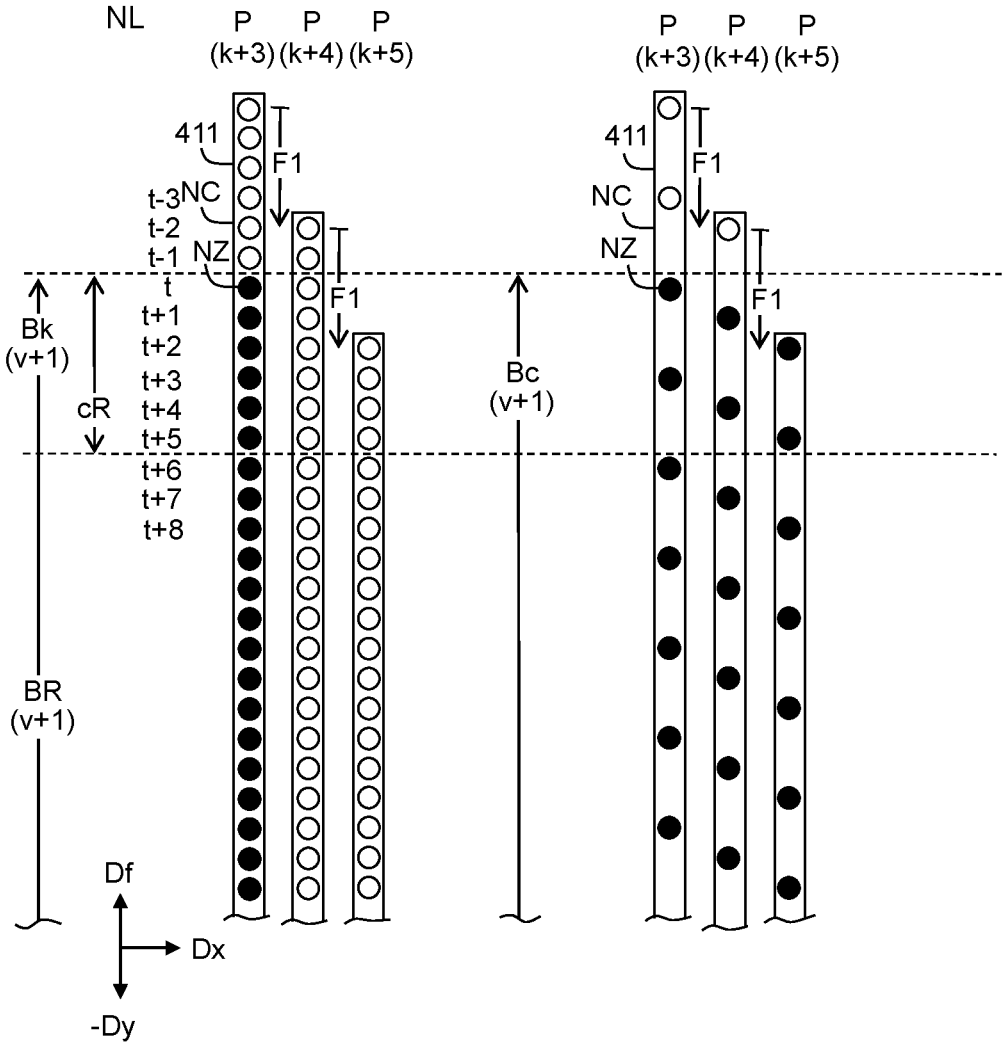
FIG. 11 is a view for explaining the pass and the positions in the sub scanning direction Dy of the nozzles.

FIG. 11 is a view for explaining the pass and the positions in the sub scanning direction Dy of the nozzles in a case that the overlap dot range on the upstream side (+Dy) is not provided. FIG. 11 indicates a v+1-th dot range Bk(v+1), a v+1-th dot range Bc(v+1), and the arrangement of the nozzle groups NK and NC in each of the three passes P(k+3), P(k+4) and P(k+5) which are same as those in FIG. 9. FIG. 11 indicates a case wherein the overlap dot ranges Rk and Rc on the upstream side (+Dy) of the v+1-th dot ranges Bk(v+1) and Bc(v+1) are not provided. In the t-th to t+5-th pixel lines of areas corresponding to the omitted overlap dot ranges Rk and Bc, respectively (in the present embodiment, an area of the candidate overlap range cR), the dots of the black K are printed by the first pass P(k−3) among the three passes P(k−3), P(k+4) and P(k+5), and the dots of the cyan C are printed by the three passes P(k−3), P(k+4) and P(k+5) (one piece of the pixel line is printed by one time of the pass).

The explanation of the cyan C in FIGS. 9 to 11 is similarly applicable to the magenta M and the yellow Y, as well.

In a case that the result of the determination in step S320 (FIG. 7A) is NO, the processor 210 determines, in step S340, as to whether or not the image of the candidate overlap range cR includes the dots of the black K, without including the dots of the color (any one of C, M and Y). In a case that the result of the determination in step S340 is YES, the processor 210 determines, in step S350, as to whether or not the image on the downstream side (on the side of −Dy) of the candidate overlap range cR includes the dots of the color (any one of C, M and Y). In the present embodiment, the processor 210 determines, in step S350, whether or not the image of the area having the band reference width and including the candidate overlap range cR includes the dots of the color. In a case that the result of the determination in step S350 is YES, the processor 320 determines, in step S392, the succeeding band range, the overlap dot range and the relationship between the pass and the positions in the sub scanning direction Dy of the nozzles, in accordance with the second relationship IS2. Then, the processor 210 ends the processing of FIGS. 7A and 7B.

Figure 12:
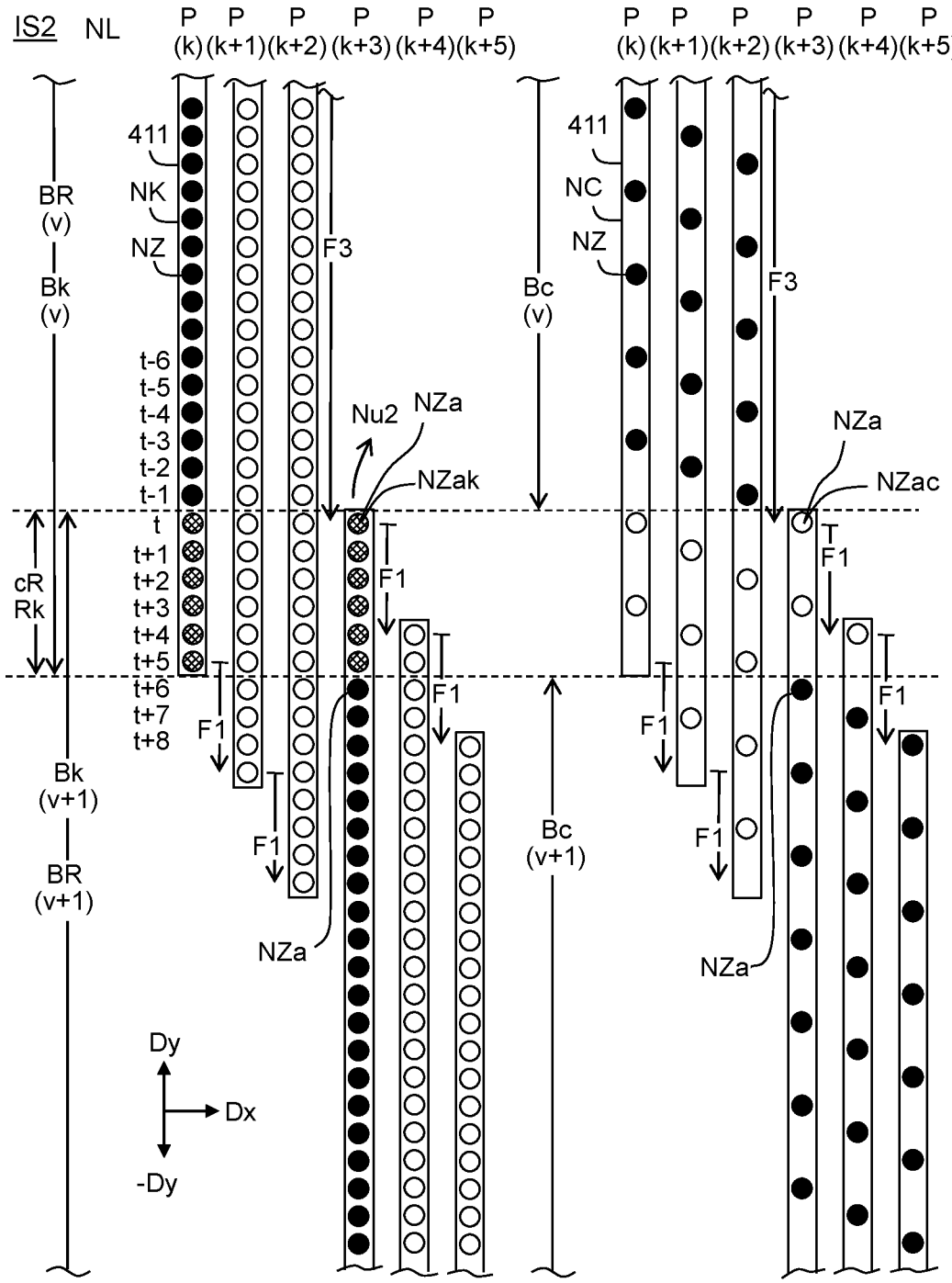
FIG. 12 is a view for explaining the pass and the positions in the sub scanning direction DY of the nozzles.

FIG. 12 is a view explaining the second relationship IS2. Unlike the example of FIG. 9, in an example depicted in FIG. 12, the image of the candidate overlap range cR includes the dots of the black K, but does not include the dots of the color (FIG. 7A: step S340: YES). Note, however, that an image on the downstream side (the side of the direction −Dy) of the candidate overlap range cR includes dots of the color (FIG. 7A: step S350: YES). The v-th dot range Bc(v) and v+1-th dot range Bc(v+1)) regarding the cyan C both do not include the candidate overlap range cR.

The difference between the second relationship IS2 and the first relationship IS1 is that the second conveying amount F2 is replaced with a third conveying amount F3. The third conveying amount F3 is greater than the second conveying amount F2. In the present embodiment, the difference between the third conveying amount F3 and the second conveying amount F2 is an integral multiple of the second nozzle pitch NPb (FIG. 3). In the example of FIG. 12, the difference between the third conveying amount F3 and the second conveying amount F2 is two times the second nozzle pitch NP2 (namely, the difference corresponds to 6 pieces of the pixel line).

The third conveying amount F3 is determined in advance as follows. Namely, the third conveying amount F3 is determined such that the dots of a pixel line on an end on the side of the sub scanning direction Dy (here, the t-th pixel line) in the candidate overlap range cR (namely, the first type overlap dot range Rk) are formed by nozzles of the same position set NZa. As explained above with reference to FIG. 3, the nozzles NZak of the black K of the same position set NZa are arranged at positions in the sub scanning direction Dy, respectively, which are common to the nozzles NZa of the cyan C. As a result, in the three times of the pass P(k+3), P(k+4) and P(k+5) for the printing of the succeeding band range BR(v+1), the arrangement of the nozzles in each of the passes P(k+3), P(K+4) and P(k+5) on the downstream side (the side of the direction −Dy) of the first type overlap dot range Rk is similar to that in the first relationship IS1. For example, the dots of the t+6-th pixel line which is adjacent to the downstream side (side of the direction −Dy) of the first type overlap dot range Rk are formed by the nozzles of the same position set NZa. Accordingly, the image on the downstream side of the first type overlap dot range Rk is printed appropriately by the three times of the pass, in a similar manner as the case wherein the first relationship IS1 is adopted.

Further, FIG. 12 indicates an external nozzle number Nu2. The external nozzle number Nu2 is made to correspond to the first pass P(k+3) among the three passes for printing the succeeding band range BR(v+1), and is a total number of the nozzles of the black K which are positioned on the side of the sub scanning direction Dy relative to the first type overlap dot range Rk. In the example of FIG. 12, the external nozzle number Nu2 is zero (0) (also referred to as a "second external nozzle number Nu2"). Namely, in the pass P(k+3), a nozzle NZak at an end in the sub scanning direction Dy of the nozzle group NK forms a dot of the pixel line at an end in the sub scanning direction Dy of the first type dot range Bk(v+1).

FIG. 9 indicates an external nozzle number Nu1 (also referred to as a "first external nozzle number Nu1"). In the present embodiment, the first external nozzle number Nu1 is 6 (six). The second external nozzle number Nu2 of the second relationship IS2 is smaller than the first external nozzle number Nu1 in the first relationship IS1. As depicted in FIGS. 9 and 12, the external nozzle numbers Nu1 and Nu2 are each a number of the nozzles which are not used in the printing. In a case that the second relationship IS2 is adopted, the number of the nozzles which are not used in the printing is small, as compared with a case that the first relationship IS1 is adopted, and thus the printing speed can be improved. Note that the phrase that "the number of the nozzles which are not used in the printing is small" means that the number of the nozzles used for the printing is great.

In a case that the result of the determination in step S350 (FIG. 7A) is "NO", the image of the candidate overlap range cR does not contain the dot of the color (any one of C, M and Y), and the image on the downstream side (on the side of −Dy) of the candidate overlap range cR also does not include the dot of the color. In this case, the processor 210 determines, in step S393, the succeeding band range, the overlap dot range, and the relationship between the pass and the positions in the sub scanning direction Dy of the nozzles, in accordance with a third relationship IS3. Then, the processor 210 ends the processing of FIGS. 7A and 7B.

Figure 13:
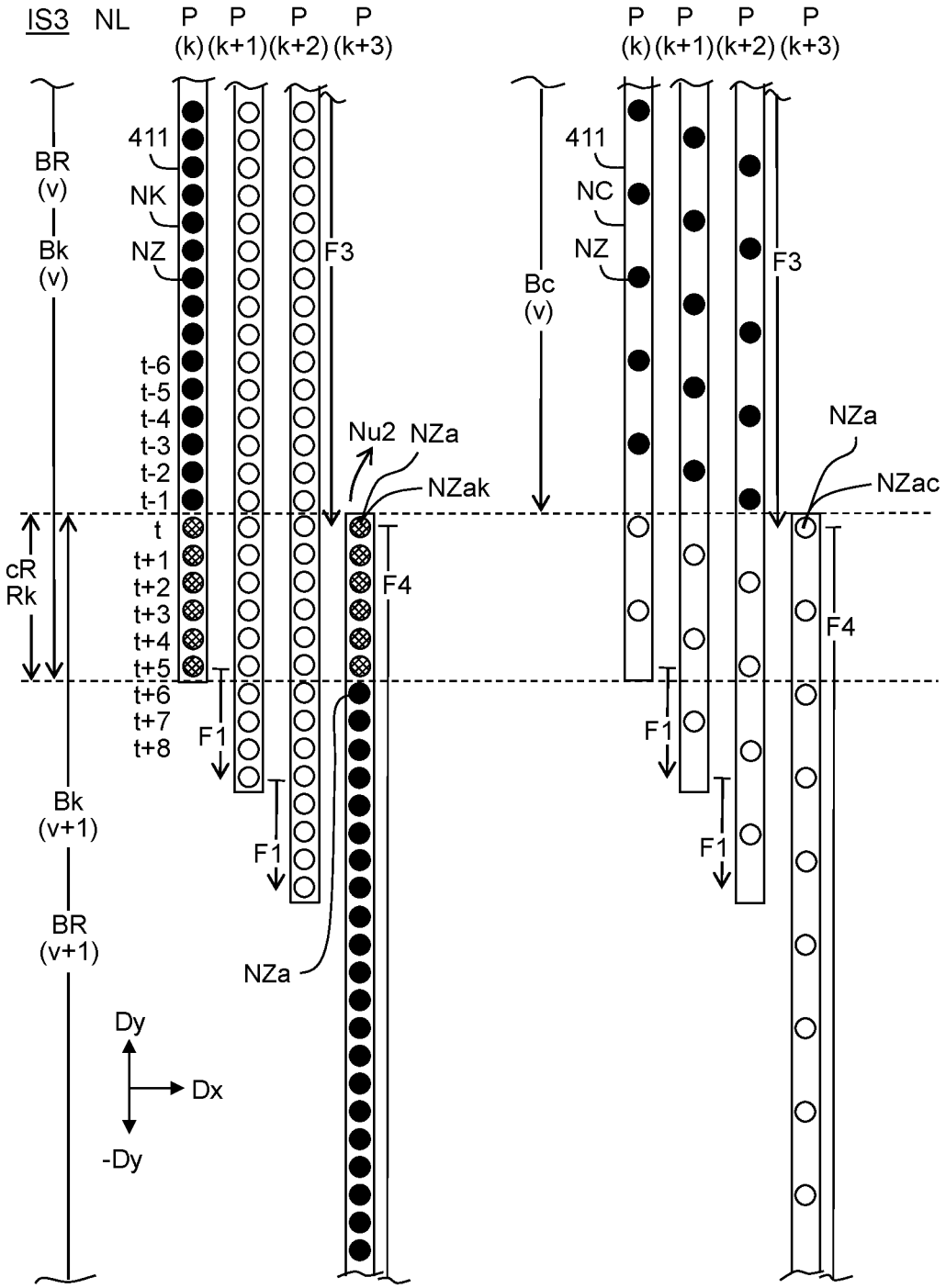
FIG. 13 is a view for explaining the pass and the positions in the sub scanning direction Dy of the nozzles.

FIG. 13 is a view explaining the third relationship IS3. Unlike the example of FIG. 12, the image of the succeeding band range BR(v+1) includes the dots of the black K, but does not include the dots of the color. The dot range Bc(v+1) regarding the cyan C and consequently the v+1th dot range regarding the color (any one of C, M and Y) are not formed. Further, the image of the succeeding band range BR(v+1) is formed by one time of the pass P(k+3).

Note that a conveying amount F4 after the pass P(k+3) is determined by the overlap dot range determining processing (FIG. 6A: step S220) for the v+1-th band range BR(v+1) and a non-illustrated v+2-th band range BR(v+2). The processor 210 determines the conveying amount F4 in accordance with (so as to match with) a position of the nozzle in the first pass for the band range BR(v+2).

In the example of FIG. 13, the printing of the image of the preceding band range BR(v) is performed in a similar manner as that in FIG. 9. Regarding the inside of the first type overlap dot range Rk, the formation of the dot pattern of the black K is performed in a similar manner as that of FIG. 9. The dots of the cyan C (and consequently the dots of the color (any one of C, M and Y) are not formed. In such a manner, in a case that a condition for forming the first type overlap dot range Rk, without forming the second type overlap dot range Rc, is satisfied (FIG. 7A, step S320: NO, step S340: YES, step S350: NO), the third relationship IS3 is adopted. In this case, a total number of passes for forming the dots in the first type overlap dot range Rk is 2 (two) (also referred to as a "third pass number"). On the other hand, as in the example of FIG. 9, in a case that the condition for forming the first type overlap dot range Rk and the second type overlap dot range Rc are satisfied (step S320: YES, step S330: NO), the first relationship IS1 is adopted. In this case, the number of pass for forming the dots in the first type overlap dot range Rk or the second type overlap dot range Rc is 6 (six) (also referred to as a "first pass number"). In such a manner, the third pass number (2) in a case that the third relationship IS3 is adopted is smaller than the first pass number (6) in a case that the first relationship IS1 is adopted. Accordingly, the speed of printing of the image can be improved. Note that in the present embodiment, the three determining steps of S320, S340 and S350 realize a determining processing of determining as to whether or not the condition for forming the first type overlap dot range Rk, without forming the second type overlap dot range Rc, is satisfied. Further, the two determining steps of S320 and S330 realize a determining processing of determining as to whether or not the condition for forming the first type overlap dot range Rk and the second type overlap dot range Rc is satisfied.

In a case that the result of the determination in step S330 (FIG. 7A) is YES, the processor determines, in step S341, the succeeding band range, the overlap dot range and the relationship between the pass and the positions in the sub scanning direction Dy of the nozzles, in according with a fourth relationship IS4. Then, the processor 210 ends the processing of FIGS. 7A and 7B.

Figure 14:
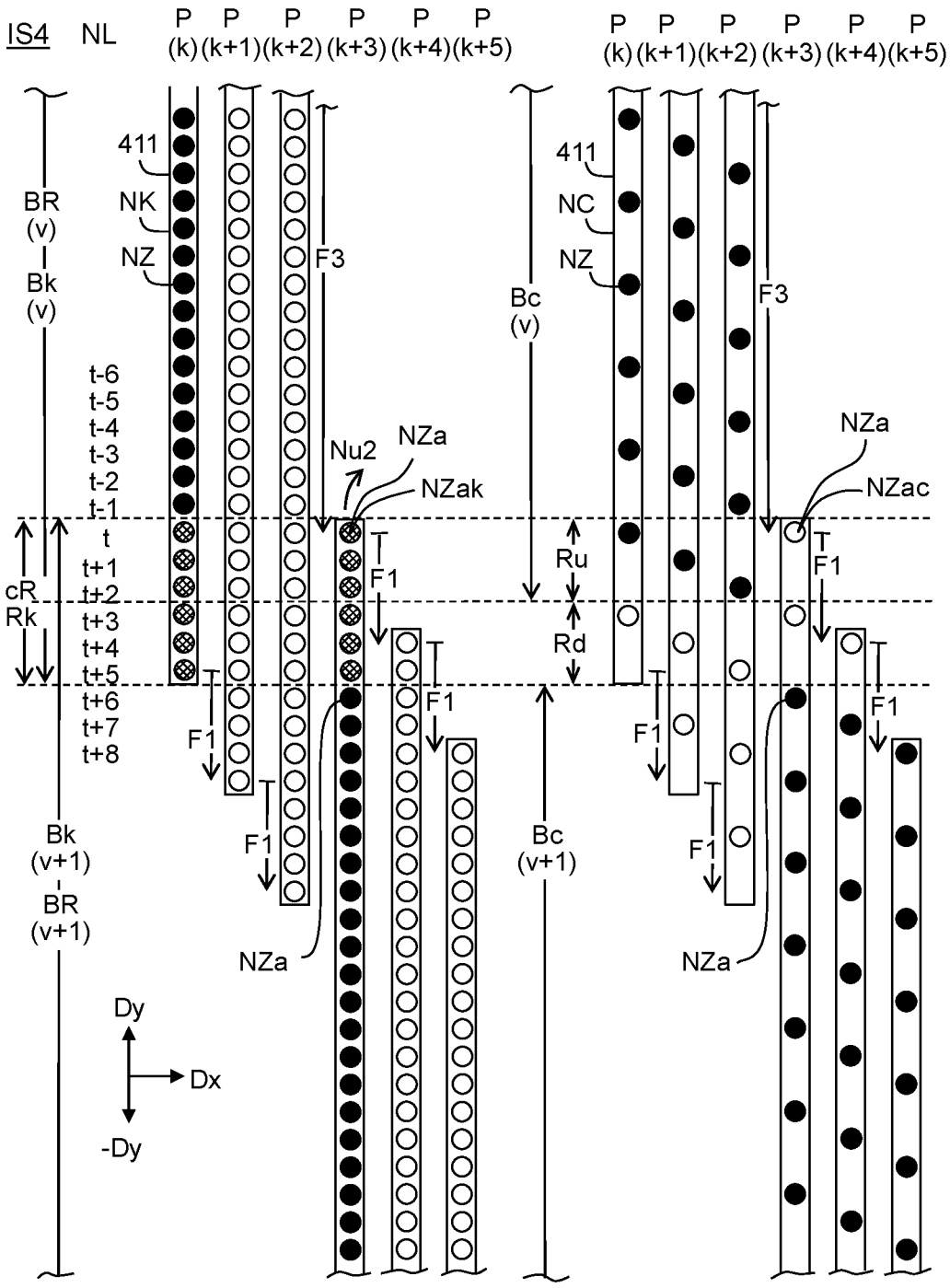
FIG. 14 is a view for explaining the pass and the positions in the sub scanning direction Dy of the nozzles.

FIG. 14 is a view explaining the fourth relationship IS4. Unlike the example of FIG. 12, an image of a first partial range Ru on the side of the sub scanning direction Dy in the candidate overlap range cR includes the dots of the cyan C, in addition to the dots of the black K. An image of a second partial range Rd, which is a remaining part of the candidate overlap range cR, includes the dots of the black K, without including the dots of the color. According to this, the result of the determination in step S330 of FIG. 7A is YES.

The positions of the nozzles in each of the passes in the fourth relationship IS4 is same as the positions of the nozzles in each of the passes in the second relationship IS2 (FIG. 12). The difference between the fourth relationship IS4 and the second relationship IS2 is that the passes P(k), P(k+1) and P(k+2) for forming the image of the preceding band range BR forms the dots of the cyan C (and consequently, of the color) of the first range Ru. One piece of the pixel line of the color in the first range R1 is printed by one time of the pass.

The first partial range Ru is a part, of the first type overlap dot range Rk, which has a predetermined size and which includes an end on the side of the sub scanning direction Dy of the first type overlap dot range Rk. The second partial range Rd is a remaining part, of the first type overlap dot range Rk, which is different from the first partial range Ru. In a case that an image included in the first partial range Ru is an image which is to be formed by using ink droplets of the color and that an image included in the second partial range Rd is an image which is to be formed without using ink droplets of the color (FIG. 7A, step S330: YES), the fourth relationship IS4 is adopted. In this case, the dots of the color within the first partial range Ru are formed by not less than one time of the pass among the passes P(k), P(k+1) and P(k+2) for forming the preceding band range BR(v), without using the passes P(k+3), P(k+4) and P(k+5) for forming the succeeding band range BR(v+1). Accordingly, the speed of printing of the image can be improved. In particular, in the present embodiment, a printing in a case that the fourth relationship IS4 is adopted is similar to the printing in a case that the second relationship IS2 (FIG. 12) is adopted, except that the printing of the color dots in the first partial range Ru is not performed. Accordingly, similar to the case that the second relationship IS2 is adopted, the printing speed can be improved. Note that the width in the sub scanning direction Dy of the first partial range Ru may be a variety of kinds of values which are greater than 0 (zero). The width in the sub scanning direction Dy of the second partial range Rd may be a variety of kinds of values which are greater than 0 (zero). For example, the width of the first partial range Ru may be ½ (half) the width of the first type overlap dot range Rk.

In a case that the result of the determination in step S340 (FIG. 7A) is NO, the image of the candidate overlap range cR includes the dot of the color, without including the dot of the black K. In this case, the processor 210 determines, in step S391, the succeeding band range, the overlap dot range and the relationship between the pass and the positions in the sub scanning direction Dy of the nozzles, in according with the first relationship IS1. Then, the processor 210 ends the processing of FIGS. 7A and 7B.

In a case that the result of the determination in step S310 (FIG. 7A) is YES, namely, in a case that a blank area is connected to the downstream side of the preceding band range BR(v), the processor 210 determines, in step S410 (FIG. 8), as to whether or not an image on the downstream side (on the side of −Dy) of the blank area includes the dot of the black K, without including the dot of the color (any one of C, M and Y). In the present embodiment, the determination in step S410 is performed by using an image of an area having the reference band width. In a case that the result of the determination in step S410 is NO, the processor 210 determines, in step S420, as to whether or not the blank area, an end area having a first width and including only the dot of the black K, and an area including a dot of the color are arranged side by side in this order toward the downstream side (the side of the direction −Dy). A condition that the result of the determination in step S420 becomes YES can be paraphrased as follows. Namely, a blank area is connected to the downstream side (the side of the direction −Dy) of the preceding band area BR(v); an end area included in an end part, of the succeeding band range BR(v+1), which has the first width and which includes an end in the sub scanning direction Dy of the succeeding band range BR(v+1) includes the dot of the black, without including the dot of the color; and an area, of the succeeding band range BR(v+1), on the downstream side of the end area of the succeeding band range BR(v+1) includes the dot of the color.

In the present embodiment, the first width is determined in advance, and is same as a width of an area constructed of Z pieces of the pixel line. The number "Z" is determined in advance, and is a value (6) obtained by multiplying the ratio F (here, 3) of the second nozzle pitch NPb of the color relative to the first nozzle pitch NPa of the black K with an integer of not less than 1 (here, 2).

In a case that the result of the determination in step S420 is NO, the processor 210 determines, in step S495, the succeeding band range, the overlap dot range and the relationship between the pass and the positions in the sub scanning direction Dy of the nozzles, in according with a fifth relationship IS5. Then, the processor 210 ends the processing of FIG. 8.

Figure 15:
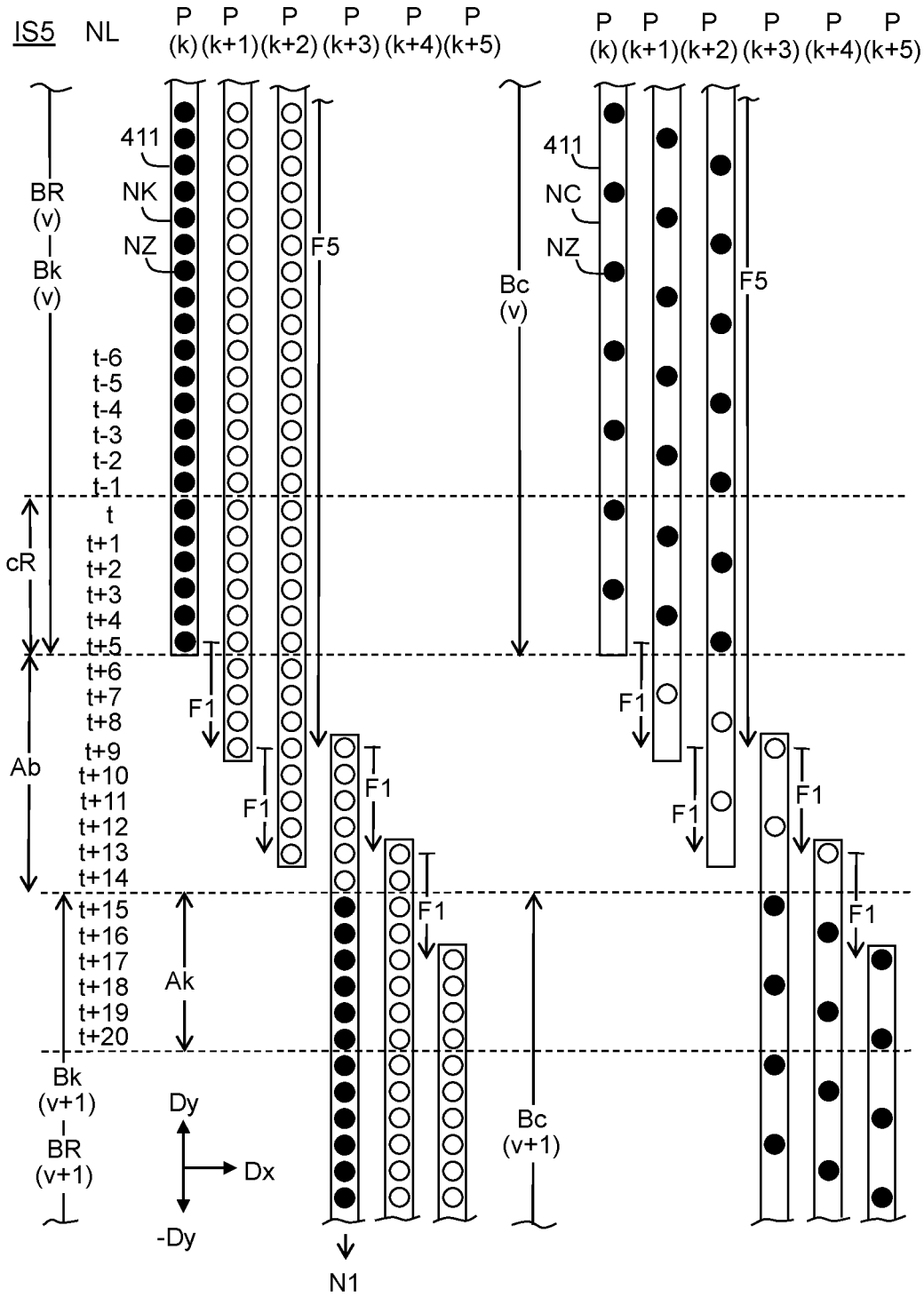
FIG. 15 is a view for explaining the pass and the positions in the sub scanning direction Dy of the nozzles.

FIG. 15 is a view explaining the fifth relationship IS5. As depicted in FIG. 15, a blank area Ab is connected to the downstream side (the side of the direction −Dy) of the preceding band range BR(v). Further, an image including the dots of the black K and the dots of the color is connected to the downstream side (the side of the direction −Dy) of the blank area Ab. From those described above, the result of the determination in step S410 is NO, and the result of the determination in step S420 is NO.

As indicated in FIG. 15, the v-th dot ranges Bk(v) and Bc(v) include the candidate overlap range cR. Printing of an image, of the preceding band range BR(v), at an end on the downstream side (on the side of −Dy) thereof (namely, images of end parts on the downstream side of the dot ranges Bk(v) and Bc(v), respectively) is same as the printing indicated in FIG. 10. In such a manner, a dot pattern included in a part, of the preceding first type dot range Bk(v), including the end on the downstream side thereof, and a dot pattern included in a part, of the preceding second type dot range Bc(v), including the end on the downstream side thereof are formed by using not less than one time of the passes P (k), P(k+1) and P(k+2) for the preceding band range BR(v), without using the passes P (k+3), P(k+4) and P(k+5) for the succeeding band range BR(v+1). Therefore, the printing speed can be improved.

Further, the succeeding band range BR(v+1) is connected to the downstream side (on the side of −Dy) of the blank area Ab. Printing of an image, of the succeeding band range BR(v+1), at an end on the upstream side (on the side of +Dy) thereof (namely, images of end parts on the upstream side of the dot ranges Bk(v+1) and Bc(v+1), respectively) is same as the printing indicated in FIG. 11. In such a manner, a dot pattern included in a part, of the succeeding first type dot range Bk(v+1), including the end thereof on the side of the sub scanning direction Dy, and a dot pattern included in a part, of the succeeding second type dot range Bc(v+1), including the end thereof on the side of the sub scanning direction Dy are formed by using not less than one time of the passes P (k+3), P(k+4) and P(k+5) for the succeeding band range BR(v+1), without using the passes P (k), P(k+1)

and P(k+2) for the preceding band range BR(v). Therefore, the printing speed can be improved.

The processor 210 determines a conveying amount F5 after the pass P(k+2), in accordance with (in conformity with) the positions of the nozzles in the pass P(k+3). The conveying amount F5 is set to be a large value so as to skip the blank area Ab. The conveying amount F5 is great as compared with the third conveying amount F3 (FIG. 12) in a case that the blank area is not connected to the downstream side of the preceding band range BR(v). Therefore, the printing speed can be improved. Note that the conveying amounts F3 and F5 are each an example of a specified conveying amount as a conveying amount of the conveying processing between the forming processing of forming the dot pattern of the preceding band range BR(v) (the three passes P(k), P(k+1) and P(k+2) and the forming processing of forming the dot pattern of the succeeding band range BR(v+1) (the three passes P(k+3), P(k+4) and P(k+5).

In a case that the result of the determination in step S410 (FIG. 8) is YES, the image which is located at the downstream side (on the side of −Dy) of the blank area and which has the band reference width includes a dot of the black K, without including a dot of the color (any one of C, M and Y). In this case, the processor 210 determines, in step S496, the succeeding band range, the overlap dot range and the relationship between the pass and the positions in the sub scanning direction Dy of the nozzles, in according with a sixth relationship IS6. Then, the processor 210 ends the processing of FIG. 8.

Figure 16:
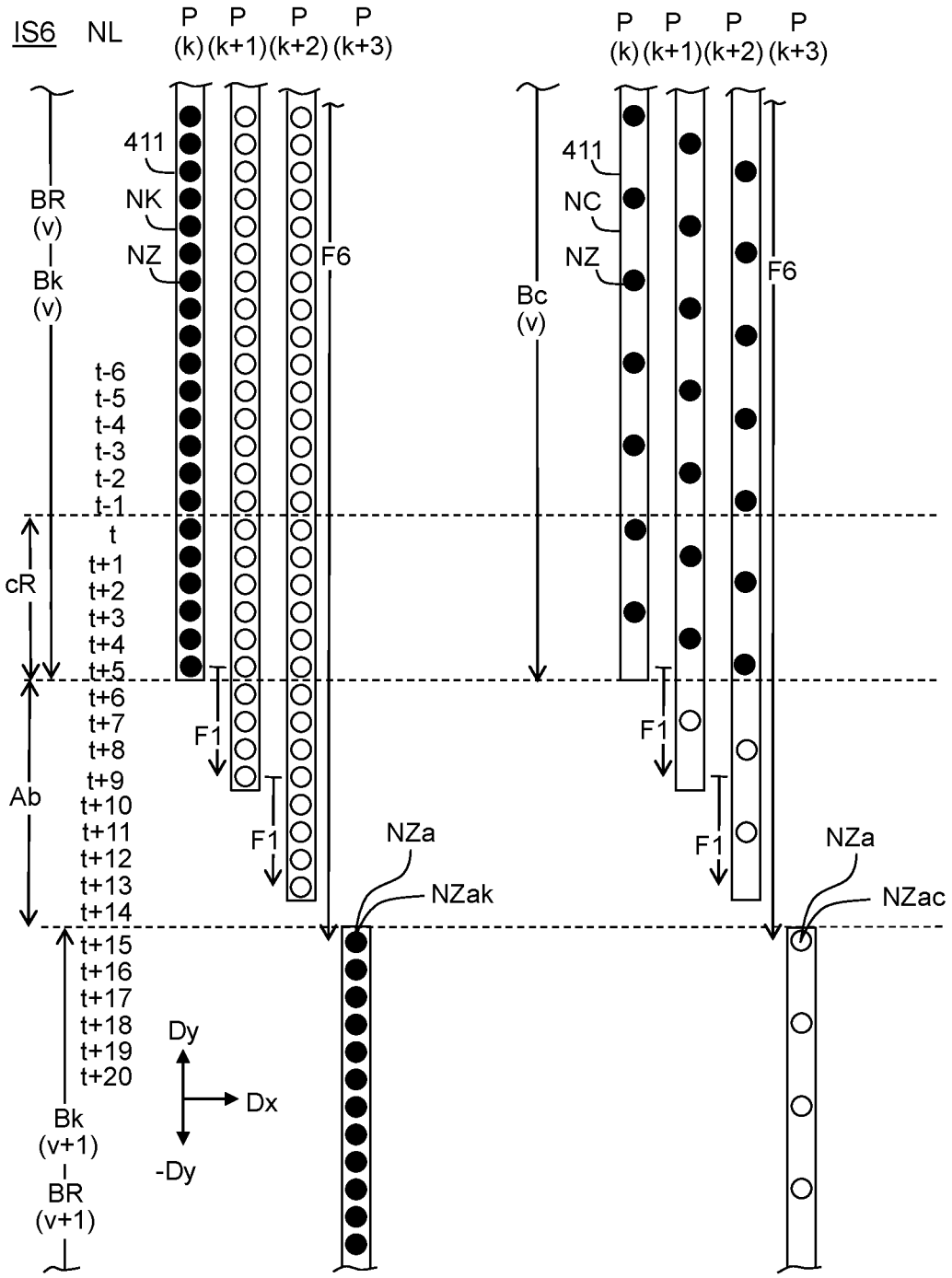
FIG. 16 is a view for explaining the pass and the positions in the sub scanning direction Dy of the nozzles.

FIG. 16 is a view explaining the sixth relationship IS6. There are three differences between the sixth relationship IS6 depicted in FIG. 16 and the fifth relationship IS5 depicted in FIG. 15, as follows. The first difference is that an image, of the succeeding blank range BR(v+1), on the downstream side (the side of the direction −Dy) of the blank area Ab includes the dots of the black K, without including the dots of the color (any one of C, M and Y). The second difference is that the v+1-th dot range Bc(v+1) regarding the cyan C, and consequently, the v+1-th dot range regarding the color (any one of C, M and Y) is not formed. The third difference is that the image of the succeeding band range BR(v+1) is formed by one time of the pass P(k+3).

A processing in a case that the sixth relationship IS6 is adopted has a variety of kinds of advantages, similarly to a case that the fifth relationship IS5 (FIG. 15) is adopted. Further, the processor 210 determines a conveying amount F6 after the pass P(k+2), in accordance with (in conformity with) the positions of the nozzles in the pass P(k+3). The conveying amount F6 is set to be a large value so as to skip the blank area Ab. The conveying amount F6 is great as compared with the third conveying amount F3 (FIG. 12) in a case that the blank area is not connected to the downstream side of the preceding band range BR(v). Therefore, the printing speed can be improved. Note that in the present embodiment, the conveying amount F6 is determined so that a nozzle NZak at the end in the sub scanning direction Dy of the nozzle group NK in the pass P(k+3) forms a dot of a pixel line at the end in the sub scanning direction Dy of the first type dot range Bk(v+1). Therefore, the conveying amount F6 is greater than the conveying amount F5 of FIG. 15. As a result, the printing speed can be improved. Note that the conveying amount F6 is an example of the specified conveying amount as the conveying amount of the conveying processing between the forming processing of forming the dot pattern of the preceding band range BR(v) (the three passes P(k), P(k+1) and P(k+2) and the forming processing of forming the dot pattern of the succeeding band range BR(v+1) (one time of pass P(k+3)), similarly to the conveying amounts F3 and F5.

In a case that the result of the determination in step S420 (FIG. 8) is YES, an area having a first width and including only the dot(s) of the black K is connected to the downstream side (the side of −Dy) of the blank area, and an area including the dot(s) of the color is connected to the downstream side of the above-described area. In such a case, the processor 210 determines, in step S497, the succeeding band range, the overlap dot range and the relationship between the pass and the positions in the sub scanning direction Dy of the nozzles, in according with a seventh relationship IS7. Then, the processor 210 ends the processing of FIG. 8.

Figure 17:
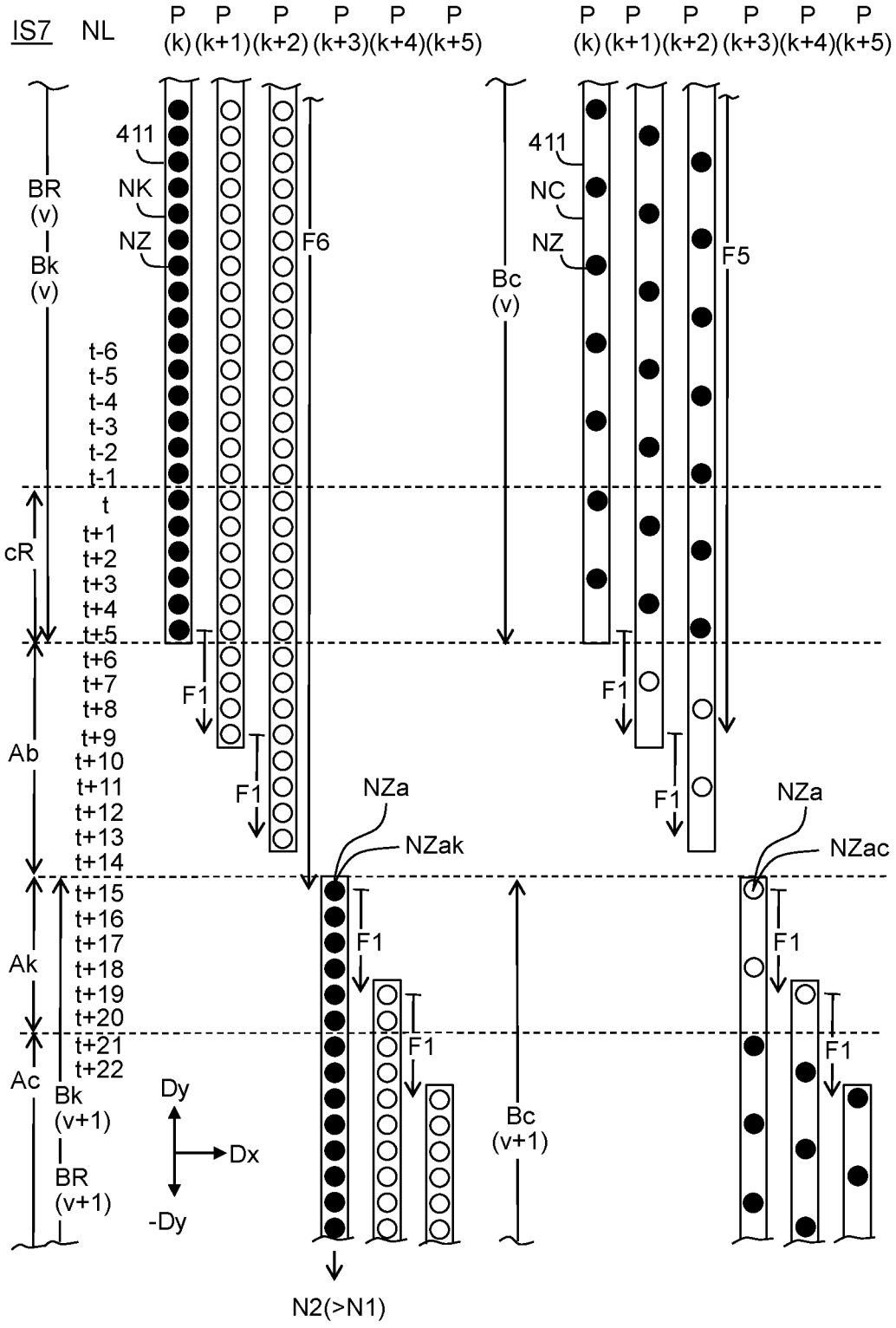
FIG. 17 is a view for explaining the pass and the positions in the sub scanning direction Dy of the nozzles.

FIG. 17 is a view explaining the seventh relationship IS7. There are three differences between the seventh relationship IS7 depicted in FIG. 17 and the sixth relationship IS6 depicted in FIG. 16, as follows. The first difference is that an end area Ak, of the succeeding band range BR(v+1), on the side of the sub scanning direction Dy includes the dots of the black K, without including the dots of the color (any one of C, M and Y). The second difference is that an area Ac, of the succeeding band range BR(v+1), which is included in a part on the downstream side in the sub scanning direction Dy of the end area Ak, includes the dots of the color (any one of C, M and Y). The third difference is that the image of the succeeding band range BR(v+1) is formed by three times of the pass which are the passes P(k+3), P(k+4) and P(k+5). Here, the dots of the black K in the end area Ak is printed by one time of the pass P(k+3).

A processing in a case that the seventh relationship IS7 is adopted has a variety of kinds of advantages, similarly to a case that the sixth relationship IS6 (FIG. 16) is adopted. For example, since the conveying amount F6 after the pass P(k+2) is set to be a large value so as to skip the blank area Ab, the printing speed can be improved. Further, the conveying amount F6 after the pass P(k+2) in the case that the seventh relationship IS7 is adopted can be made greater than the conveying amount F5 after the pass P(k+2) in the case that the fifth relationship IS5 (FIG. 15) is adopted, to an extent corresponding to the width of the end area Ak. Accordingly, the printing speed can be improved.

Further, FIG. 17 indicates a specified nozzle number N2. The specified nozzle number N2 is a total number of the nozzles of the black K used for the pass P(k+3) for forming the dot pattern of the end area Ak. In the following, the specified nozzle number N2 of FIG. 17 is also referred to as a "second specified nozzle number N2". FIG. 15 indicates the specified nozzle number N1 (also referred to as a "first specified nozzle number N1"). In the pass P(k+3) of FIG. 15, the nozzle group of the black K has six pieces of the nozzle NZ which are arranged on the side of the sub scanning direction Dy relative to the end area Ak and which are not used. In the pass P(k+3) of FIG. 17, the total number of the nozzles NZ which are arranged on the side of the sub scanning direction Dy relative to the end area Ak and which are not used is 0 (zero). Accordingly, the second specified nozzle number N2 may be a value greater than the first specified nozzle number N1. Accordingly, the printing speed can be improved.

[Modifications]

(1) <First Modification>

The print processing may be a variety of kinds of other processings, instead of the above-described processing. For example, among the three passes for printing one piece of the band image, the second pass or the third pass may form the dot(s) of the black K. The printing of one piece of the pixel line of the black K in the first type overlap dot range Rk may be divided into three times or four times of the pass. Further, it is allowable that one piece of the band image is a variety of kinds of images such that overlap ranges are made in both of an end in the direction +Dy and an end in the direction −Dy thereof, respectively. Furthermore, the number of time(s) of the pass used for printing of one piece of the band image may be a variety of kinds of number of time(s) not less than one time. Note that the upper limit of the number of time(s) of the pass may be determined in advance (in the present embodiment, the upper limit is three times). Moreover, the ratio of the number X of the nozzles NZ of the black K to the number W of the nozzles NZ of the nozzle group NZ of the color (for example, the nozzle group NC of the cyan C) may be different from the ratio of the second pitch NPb of the color (for example, cyan C) to the first nozzle pitch NPa of the black K.

(2) <Second Modification>

The corresponding relationship among the conveying amount, the pixel line, and the nozzle(s) forming the dot(s) in the pixel line may be a variety of kinds of other corresponding relationships, instead of the corresponding relationship in each of the embodiment and modification described above. For example, the processings in FIGS. 8 and 7 may be modified so as to omit at least one of the relationships IS2 to IS7. For example, the step S310 may be omitted. In such a case, the print data may be generated in accordance with any one of the four relationships which are the relationships IS1 to IS4. Further, the width in the sub scanning direction Dy of the overlap dot range may be different among the respective color components. For example, the width of the second type overlap dot range Rc may be wider than the width of the first type overlap dot range Rk.

(3) <Third Modification>

The print processing may be a variety of kinds of other processings, instead of the processing in FIG. 5. For example, the processings of steps S150 to S190 may be repeated for each of the band images.

(4) <Fourth Modification>

The configuration of the liquid droplet discharge apparatus may be a variety of kinds of other configurations, instead of the configuration depicted in FIGS. 1 to 3. For example, the ink supplying part 450 may be fixed to the carriage 433. The positions in the sub scanning direction Dy of the upstream-most nozzles NZYu, NZCu and NZMu of the CMY in FIG. 3 may be different from the position in the sub scanning direction Dy of the upstream-most nozzle NZKu of the black K in FIG. 3. It is allowable that the moving device 430 moves the medium such as the paper sheet PM, etc., instead of moving the head unit 410, so as to move the head unit 410 relative to the medium in the main scanning direction. The medium is not limited to or restricted by being the paper (paper sheet), and may be a variety of kinds of media such as cloth, film, etc. The combination of the colors of a plurality of kinds of inks which are usable is not limited to the CMYK; it is allowable to use a while ink, a transparent ink, an ink having a metallic luster, etc. The ink may be a pigment ink or a dye ink, and may be a ultraviolet-curable ink such as a UV ink, an ink containing an organic solvent such as a solvent ink, or an ink containing a metal. It is allowable that a variety of kinds of liquids (for example, a molten resin, etc.), rather than the ink, is discharged or ejected from the nozzles. In any of these cases, the configuration of the head unit may be a variety of kinds of configuration each having X pieces (X being an integer of not less than 2) of the first type nozzles of which positions in the sub scanning direction are mutually different, W piece (W being an integer in a range of not less than 1 and less than X) of the second type nozzles of which positions in the sub scanning direction are mutually different. Further, the first liquid discharged by the first type nozzles may be a variety of kinds of liquids, and the second liquid discharged by the second type nozzles may be a variety of kinds of liquids different from the first liquid.

(5) <Fifth Modification>

A data processing (for example, at least a part of the processings in steps S110 to S180 in FIG. 5) may be executed by an external data processing apparatus (for example, a personal computer, a digital camera, a scanner, a smartphone, etc.) which is connected to the liquid droplet discharge apparatus, rather than the controller of the liquid discharge apparatus such as the multifunctional peripheral 200. It is allowable that a plurality of apparatuses (for example, computers) which are capable of communicating with each other via a network are assigned with parts, respectively, of the function of the data processing by the data processing apparatus, and provide the function of the data processing as a whole (a system provided with these apparatuses corresponds to the data processing apparatus).

(6) The technique disclosed in the present specification can be realized as the following aspects.

[Aspect 1] A liquid droplet discharge apparatus characterized by including:

a head which discharges a liquid droplet of a liquid and which has: a first type nozzle group, and a second type nozzle group in which spacing distance between nozzles are longer than that in the first type nozzle group;

a moving device which moves the head between a first position and a second position;

a conveyor which conveys a medium; and a controller, wherein the controller executes:

a first print processing of printing a first pass, and a second print processing of printing a second pass having an overlap range in which a part of the second pass overlaps with the first pass; and in a case that the liquid droplet is discharged in the overlap range from the first nozzle group and the liquid droplet is not discharged in the overlap range from the second nozzle group, a number of times of moving the head from the first position to the second position and a number of times of moving the head from the second position to the first position are smaller than those in a case that the liquid droplet is discharged in the overlap range from each of the first type nozzle group and the second type nozzle group.

According to this configuration, since the number of time(s) of movement of the head is small, it is possible to improve the speed of forming the dot pattern. Here, a nozzle group having a small nozzle pitch NPa such as the nozzle group NK of the black K (FIG. 3) is an example of the first type nozzle group, and a nozzle group having a large nozzle pitch NPb such as the nozzle groups NY, NC and NM of the color is an example of the second type nozzle group. The first type nozzle group may discharge or eject a liquid droplet of a first liquid, and the second type nozzle group may discharge or eject a liquid droplet of a second liquid different from the first liquid. The position on the side of the direction Dx of the paper sheet PM (FIG. 4) is an example of the first position, and the position on the side of the direction −Dx of the paper sheet PM is an example of the second position. The pass processing for printing an image of the preceding band range is an example of the first print processing of printing the first pass, and the pass processing for printing an image of the succeeding band range is an example of the second print processing of printing the second pass. A case that the third relationship IS3 (FIG. 13) is adopted is an example of a "case that the liquid droplet is discharged in the overlap range from the first nozzle group and the liquid droplet is not discharged in the overlap range from the second nozzle group". A case that the first relationship IS1 (FIG. 9) is adopted is an example of a "case that the liquid droplet is discharged in the overlap range from each of the first type nozzle group and the second type nozzle group". The total number of times of the pass processing is an example of the number of times of moving the head.

[Aspect 2] The liquid droplet discharge apparatus as described in Aspect 1, characterized in that the overlap range is constructed of a dot line in which a plurality of dots are aligned;

in a case that a number of the dot line formed by the second type nozzle group in the overlap range is smaller than a majority of the dot line in the overlap range, the number of times of moving the head while discharging the liquid droplet from the second type nozzle group in the overlap range is smaller than the number of times of moving the head while discharging the liquid droplet from the first type nozzle group in the overlap range.

According to this configuration, since the number of times of moving the head is small, the speed of forming the dot pattern can be improved. Here, whether or not there is a "case that a number of the dot line formed by the second type nozzle group in the overlap range is smaller than a majority of the dot line in the overlap range" may be determined by using the majority of the dot lines on the upstream side in the overlap range, as the condition of step S330 in FIG. 7A. Instead of this, it is allowable to determine as to whether or not the number of the dot line in which the dot(s) are formed by the second type nozzle group is smaller than the majority, regardless of the position in the inside of the overlap range. In any of these cases, in the case that the number of the dot line formed by the second type nozzle group in the overlap range is smaller than the majority of the dot line in the overlap range, the number of time(s) of moving the head while discharging the liquid droplet(s) from the second type nozzle group in the overlap range (referred to as a second type number of time(s) of moving) is small. Further, it is allowable that the second type number of time(s) of moving is smaller than the number of time(s) of moving the head while discharging the liquid droplet(s) from the first type nozzle group in the overlap range.

[Aspect 3] The liquid droplet discharge apparatus as described in Aspect 1 or Aspect 2, characterized in that in the case that the liquid droplet is discharged in the overlap range from the first nozzle group and the liquid droplet is not discharged in the overlap range from the second nozzle group, the controller forms a close part which is located closely to the overlap range and which is formed by using the second type nozzle group, only by moving the head from the first position to the second position or by moving the head from the second position to the first position.

According to this configuration, it is possible to suppress, in the close part located closely to the overlap range, any deviation in the quality of the dots (for example, in a printed color) due to any difference in the moving direction of the head (for example, any difference in the order of overlaying liquid droplets of different kinds). Here, a case that the second relationship IS2 (FIG. 12) is adopted is an example of the "case that the liquid droplet is discharged in the overlap range from the first nozzle group and the liquid droplet is not discharged in the overlap range from the second nozzle group". Dot lines adjacent to the overlap range (for example, the t−1-th pixel line and the t+6-th pixel line in FIG. 12) are each an example of a "close part which is located closely to the overlap range and which is formed by using the second type nozzle group". Further, it is preferred that the moving direction (direction +Dy or the direction −Dy) of moving the head for the dot formation is same between these pixel lines.

[Aspect 4] The liquid droplet discharge apparatus as described in Aspect 1, characterized in that in a case that the controller executes the second print processing in the overlap range, a number of a first type nozzle, which is included in a plurality of first type nozzles in the first type nozzle group and which is located on the upstream side relative to the overlap range in a conveying direction in which the conveyor conveys the medium is smaller in a case that the overlap range is printed without using the second type nozzle group than that in a case that the overlap range is printed by using the second type nozzle group.

According to this configuration, since the number of the first type nozzle which is located on the upstream side and which is not used in the print processing is small, the speed of forming the dot pattern can be improved. Here, a case that the second relationship IS2 is adopted (FIG. 12) is an example of a "case that the overlap range is printed without using the second type nozzle group"; and a case that the first relationship IS1 is adopted (FIG. 9) is an example of a "case that the overlap range is printed by using the second type nozzle group".

[Aspect 5] The liquid droplet discharge apparatus as described in Aspect 1, characterized in that a number of nozzles which are used among the first type nozzle group in a case that the overlap range is printed without using the second type nozzle group is greater than that in a case that the overlap range is printed by using the second type nozzle group.

According to the configuration, since the number of the nozzles which are used is great, the speed of forming the dot pattern can be improved. Here, a case that the second relationship IS2 is adopted (FIG. 12) is an example of a "case that the overlap range is printed without using the second type nozzle group"; and a case that the first relationship IS1 is adopted (FIG. 9) is an example of a "case that the overlap range is printed by using the second type nozzle group". As explained with reference to FIGS. 9 and 12, the number of the nozzles of the black K used in the first pass P(k+3) for printing the succeeding band range BR (v+1) in a case that the second relationship IS2 is adopted is greater than that in a case that the first relationship IS1 is adopted.

[Aspect 6] The liquid droplet discharge apparatus as described in Aspect 4, characterized in that a spacing distance between nozzles in the second type nozzle group is F times (F being an integer of not less than 2) a spacing distance in nozzles in the first type nozzle group;

the overlap range is constructed of F×L (L being an integer of not less than 1) pieces of a dot line arranged side by side in the sub scanning direction; and in a case that the controller prints the overlap range, the controller moves, by the conveyor, a position of the medium from a first state to a second state, the first state being a state wherein a number of nozzles, included in a plurality of nozzles in the first type nozzle group and arranged on the upstream side in the conveying direction relative to the overlap range is a multiple of the F pieces, and the second state being a state wherein the number of the nozzles, included in the plurality of nozzles in the first type nozzle group and arranged on the upstream side in the conveying direction relative to the overlap range is smaller than a value obtained by subtracting the F pieces from the number of the nozzles in the first state.

According to this configuration, in a case that a nozzle of the first nozzle group has any inconvenience (for example, clogging, etc.), any continuation of a line of (having) an inappropriate dot is suppressed, thereby making it possible to suppress any lowering in the quality of the dot pattern which is formed. Here, the so-called nozzle pitch is an example of the spacing distance between the nozzles. Further, the moving of the medium between the pass P(k+3) and the pass P(k+4) in the first relationship IS1 (FIG. 9) is an example of the moving of the medium from the first state to the second state.

[Aspect 7] The liquid droplet discharge apparatus as described in any one of Aspects 1 to 6, characterized in that the controller executes, in the second print processing, a blank area determining processing of determining as to whether or not a blank area in which the liquid droplet is not discharged is present in the second pass; and in a case that the blank area in which the liquid droplet is not discharged is present in the second pass, the controller forms a close area which is located closely to the blank area by only moving the head from the first position to the second position or by only moving the head from the second position to the first position.

According to this configuration, it is possible to suppress, in the close area located closely to the blank range or blank area, any deviation in the quality of the dots (for example, in a printed color) due to any difference in the moving direction of the head (for example, any difference in the order of overlaying liquid droplets of different kinds). Here, the processing in step S310 of FIG. 7A is an example of a "blank area determining processing of determining as to whether or not a blank area in which the liquid droplet is not discharged is present in the second pass". Dot lines adjacent to the blank area (for example, the t+5-th pixel line and the t+15-th pixel line in FIG. 15) are each an example of a "close area located closely to the blank area". Further, it is preferred that the moving direction (direction +Dy or the direction −Dy) of moving the head for the dot formation is same between these pixel lines. Furthermore, the close area located closely to the downstream side of the blank area (for example, the end area Ak in FIGS. 15 and 17) is an example of a "close area located closely to the blank area". Furthermore, it is preferred that the moving direction (direction +Dy or the direction −Dy) of moving the head for the dot formation in the end area Ak is same.

[Aspect 8] The liquid droplet discharge apparatus as described in Aspect 7, characterized in that in a case that the controller executes the second print processing in a specified area which is an area on the downstream side relative to the blank area, a number of a first type nozzles, which is included in a plurality of first type nozzles in the first type nozzle group and which is located on the upstream side relative to the specified area in a conveying direction in which the conveyor conveys the medium in a case that the liquid droplet is discharged from the first type nozzle group in the specified area and the liquid droplet is not discharged from the second type nozzle group in the specified area is smaller than that in a case that the liquid droplet is discharged from each of the first type nozzle group and the second type nozzle group in the specified area.

According to the configuration, since the number of the first kind nozzles located on the upstream side of the specified area and which are not used in the print processing is small, the speed of forming the dot pattern can be improved. Here, the end area Ak in FIGS. 15 and 17 is an example of a "specified area which is an area on the downstream side relative to the blank area". A case that the seventh relationship IS7 (FIG. 17) is adopted is an example of a "case that the liquid droplet is discharged from the first type nozzle group in the specified area and the liquid droplet is not discharged from the second type nozzle group in the specified area". A case that the fifth relationship IS5 (FIG. 15) is adopted is an example of a "case that the liquid droplet is discharged from each of the first type nozzle group and the second type nozzle group in the specified area". In any of these cases, the first kind nozzle(s) which are located on the upstream side relative to the specified area are the nozzles which are not used. In the example of FIG. 17, the number of the nozzle of the black K on the upstream side (the side of +Dy) of the end area Ak is zero (0) in the first pass P(k+3) for printing the succeeding band range BR(v+1). In the example of FIG. 15, the number of the nozzle of the black K on the upstream side (the side of +Dy) of the end area Ak is six (6) in the first pass P(k+3) for printing the succeeding band range BR(v+1). In such a manner, in a case that the seventh relationship IS7 (FIG. 17) is adopted, the number of the nozzles which are not used is smaller than that in a case that the fifth relationship IS5 (FIG. 15) is adopted.

[Aspect 9] The liquid droplet discharge apparatus as described in Aspect 7, characterized in that a number of nozzles, which are included in a plurality of nozzles in the first type nozzle group and which are used is greater in a case that the liquid droplet is discharged from the first type nozzle group in a close area located closely to the blank area and the liquid droplet is not discharged from the second type nozzle group in the close area than in a case that the liquid droplet is discharged from each of the first type nozzle group and the second type nozzle group in the close area located closely to the blank area.

According to the configuration, since the number of the nozzles which are used is great, the speed of forming the dot pattern can be improved. Here, the close area located closely to the downstream side of the blank area (for example, the end area Ak of FIGS. 15 and 17) is an example of a "close area located closely to the blank area". A case that the seventh relationship IS7 (FIG. 17) is adopted is an example of a "case that the liquid droplet is discharged from the first type nozzle group in the close area located closely to the blank area and the liquid droplet is not discharged from the second type nozzle group in the close area". A case that the fifth relationship IS5 (FIG. 15) is adopted is an example of a "case that the liquid droplet is discharged from each of the first type nozzle group and the second type nozzle group in the close area located closely to the blank area". As explained with reference to FIGS. 15 and 17, the total number N2 of the nozzles of the black K used in the first pass P(k+3) for printing the succeeding band range BR(v+1) in a case that the seventh relationship IS7 is adopted is greater than the total number N1 of the nozzles of the black K used in the first pass P(k+3) for printing the succeeding band range BR(v+1) in a case that the fifth relationship IS5 is adopted.

In each of the embodiment and modifications described above, a part of the configuration realized by the hardware may be replaced by a software; conversely, a part or all of the configuration realized by the software may be replaced by the hardware. For example, the processings in steps S150, S160 and S170 of FIG. 5 may be realized by a dedicated hardware circuit.

Further, in a case that a part or all of the function of the present disclosure is realized by a computer program, the program may be provided in a form wherein the program is stored in a computer-readable medium (for example, a non-volatile medium). The program may be used in a state that the program is stored in a medium (computer-readable medium) which is same as or different from the medium at the time that the program is provided. The term "computer-readable medium" is not limited to or restricted by a portable type medium such as a memory card, a CD-ROM, etc., and may also include an internal memory such as a variety of kinds of ROM, etc., inside a computer, an external memory such as a hard disk drive, etc., connected to the computer.

In the foregoing, although the present disclosure has been explained based on the embodiment and modifications thereof, the embodiment and modifications thereof of the present disclosure as described above are provided so that the present disclosure is easily understood, and are not intended to limit the present disclosure in any way. The present disclosure may be changed and/or improved without departing from the gist and spirit of the present disclosure, and encompasses any equivalent of the present disclosure.

What is claimed is:

1. A liquid droplet discharge apparatus comprising:

a head unit having X of first type nozzles ($X \geq 2$) configured to discharge a first type liquid droplet of a first liquid and W of a second type nozzle ($1 \leq W < X$) configured to discharge a second type liquid droplet of a second liquid, wherein positions of the X of the first type nozzles in a sub scanning direction are different from each other, and positions of the W of the second type nozzles in the sub scanning direction are different from each other;

a moving device configured to move the head unit relative to a medium in a main scanning direction orthogonal to the sub scanning direction;

a conveyor configured to convey the medium relative to the head unit in the sub scanning direction; and a controller configured to control the head unit, the moving device, and the conveyor, wherein the controller is configured to:

execute, a plurality of times, each of a forming processing and a conveying processing, wherein the forming processing is a processing in which dots are formed on the medium by the head unit while causing the moving device to move the head unit relative to the medium in the main scanning direction, and the conveying processing is a processing in which the medium is conveyed in the sub scanning direction by the conveyor;

generate first data for forming a first dot pattern by executing the forming processing T time ($T \geq 1$), the first data indicating a preceding first type dot area as an area in which the first type liquid droplet is to be discharged, and a preceding second type dot area as an area in which the second type liquid droplet is to be discharged; and generate second data for forming a second dot pattern by executing the forming processing U time ($U \geq 1$), following formation of the first dot pattern, the second data indicating a succeeding first type dot area as an area in which the first type liquid droplet is to be discharged, and a succeeding second type dot area as an area in which the second type liquid droplet is to be discharged, wherein a first type overlap dot range is defined as a part, in which a preceding first type dot range as a range in the sub scanning direction of the preceding first type dot area overlaps with a succeeding first type dot range as a range in the sub scanning direction of the succeeding first type dot area, wherein a second type overlap dot range is defined as a part, in which a preceding second type dot range as a range in the sub scanning direction of the preceding second type dot area overlaps with a succeeding second type dot range as a range in the sub scanning direction of the succeeding second type dot area, wherein the controller is configured to:

determine as to whether or not a first condition for forming the first type overlap dot range and the second type overlap dot range is satisfied, and determine as to whether or not a second condition for forming the first type overlap dot range, without forming the second type overlap dot range, is satisfied, and wherein the controller is configured to generate the first data and the generation of the second data such that the number of times of executing the forming processing of discharging the liquid droplets to an area of the first type overlap dot range in a case that the controller has determined that the second condition is satisfied is made to be smaller than the number of times of executing the forming processing of discharging the liquid droplets to the area of the first type overlap dot range or to an area of the second type overlap dot range in a case that the controller has determined that the first condition is satisfied.

2. The liquid droplet discharge apparatus according to claim 1, wherein the controller is configured to determine as to whether or not a third condition is satisfied, wherein the third condition includes: (1) a dot pattern included in a first partial range which is a part having a predetermined size and including an end on a side of the sub scanning direction of the first type overlap dot range is a dot pattern to be formed by using the second type liquid droplet, and (2) a dot pattern included in a second partial range which is a remaining part different from the first partial range in the first type overlap dot range is a dot pattern to be formed without using the second type liquid droplet, wherein in a case that the controller has determined that the third condition is satisfied, the controller is configured to generate the first data so as to form a plurality of dots, each of which is formed of the second type liquid droplet, in the first partial range by executing the forming processing not less than one time included in the T time of the forming processing, without executing the forming processing the U time.

3. The liquid droplet discharge apparatus according to claim 1, wherein a direction opposite to the sub scanning direction is defined as a downstream direction, wherein a dot pattern, among the first dot pattern, which is to be included in the first type overlap dot range is a dot pattern to be formed by using the first type liquid droplet, without using the second type liquid droplet, wherein a part, of the second dot pattern, which is connected to a side in the downstream direction of the first type overlap dot range is a dot pattern to be formed by using the second type liquid droplet, and wherein the controller is configured to generate the second data so as to form dots of a dot line, which is located at an end on a side of the sub scanning direction of the first type overlap dot range, by a first type nozzle included in the X of the first type nozzles and arranged at a position in the sub scanning direction which is common with that of a second type nozzle among the W the second type nozzles.

4. The liquid droplet discharge apparatus according to claim 1, wherein in a case that a first forming processing among the U time of the forming processing is executed, a total number of a first type nozzle included in the X of the first type nozzles and located on a side of the sub scanning direction relative to the first type overlap dot range is defined as an external nozzle number, and wherein in a case that the controller has determined that the second condition is satisfied, the controller is configured to generate the first data and the second data such that the external nozzle number in a case that the controller has determined that the second condition is satisfied is smaller than that in a case that the controller has determined that the first condition is satisfied.

5. The liquid droplet discharge apparatus according to claim 4, wherein X of first type positions, which are positions in the sub scanning direction of the X of the first type nozzles are arranged at equal intervals therebetween with a first pitch, wherein W of second type positions, which are positions in the sub scanning direction of the W of the second type nozzles are arranged at equal intervals therebetween with a second pitch which is F times ($F \geq 2$) the first pitch, wherein a resolution of dots in the sub scanning direction of the first dot pattern and a resolution of dots in the sub scanning direction of the second dot pattern are same as a resolution corresponding to the first pitch, wherein the first type overlap dot range is constructed of $F \times L$ of dot lines ($L \geq 1$) arranged side by side in the sub scanning direction, and wherein in a case that the controller has determined that the first condition is satisfied, the controller is configured to generate the second data such that the second data indicates a conveying amount of the conveying processing between the first forming processing and a second forming processing among the U time of the forming processing, wherein the conveying amount is greater than the second pitch.

6. The liquid droplet discharge apparatus according to claim 1, wherein a direction opposite to the sub scanning direction is defined as a downstream direction, wherein the controller is configured to determine as to whether or not a blank area in which the liquid droplets are not discharged is connected to a side of the downstream direction of the first dot pattern, and wherein in a case that the controller has determined that the blank area is connected to the side of the downstream direction of the first dot pattern, the controller is configured to generate the first data so as to form a dot pattern included in a part including an end on the side of the downstream direction of the preceding first type dot range and a dot pattern included in a part including an end on the side of the downstream direction of the preceding second type dot range, by executing not less than one time among the T time of the forming processing, without executing the U time of the forming processing.

7. The liquid droplet discharge apparatus according to claim 1, wherein a direction opposite to the sub scanning direction is defined as a downstream direction, wherein a conveying amount between the T time of the forming processing and the U time of the forming processing is defined as a specified conveying amount, wherein the controller is configured to determine as to whether or not a blank area in which the liquid droplets are not discharged is connected to a side of the downstream direction of the first dot pattern, and wherein in a case that the controller has determined that the blank area is connected to the side of the downstream direction of the first dot pattern, the controller is configured to generate the second data such that the second data indicates the specified conveying amount which is greater than that in a case that the controller has determined that the blank area is not connected to the side of the downstream direction of the first dot pattern.

8. The liquid droplet discharge apparatus according to claim 1, wherein a direction opposite to the sub scanning direction is defined as a downstream direction, wherein the controller is configured to determine as to whether or not a blank area in which the liquid droplets are not discharged is connected to a side of the downstream direction of the first dot pattern, and wherein in a case that the controller has determined that the blank area is connected to the side of the downstream direction of the first dot pattern, the controller is configured to generate the second data so as to form a dot pattern included in a part including an end on the side of the sub scanning direction of the succeeding first type dot range and a dot pattern included in a part including an end on the side of the sub scanning direction of the succeeding second type dot range, by executing not less than one time among the U time of the forming processing, without executing the T time of the forming processing.

9. The liquid droplet discharge apparatus according to claim 1, wherein a direction opposite to the sub scanning direction is defined as a downstream direction, wherein the controller is configured to:

determine as to whether or not a third condition is satisfied, wherein the third condition includes: (1) a blank area in which the liquid droplets are not discharged is connected to a side of the downstream direction of the first dot pattern, and (2) an end part dot pattern which is a part having a predetermined width and including an end on the side of the sub scanning direction of the second dot pattern is a dot pattern which is to be formed by using the first type liquid droplet, without using the second type liquid droplet; and determine as to whether or not a fourth condition is satisfied, wherein the fourth condition includes: (1) a blank area in which the liquid droplets are not discharged is connected to the side of the downstream direction of the first dot pattern, and (2) the end part dot pattern is a dot pattern which is to be formed by using the first type liquid droplet and the second type liquid droplet, wherein a total number of a first type nozzle, among the X of the first type nozzles, used in the forming processing for forming the end part dot pattern is defined as a specified nozzle number, and wherein in a case that the controller has determined that the third condition is satisfied, the controller is configured to generate the second data so as to form the end part dot pattern with the specified nozzle number which is greater than that in a case that the controller has determined that the fourth condition is satisfied.

* * * * *